US005553399A

United States Patent [19]

Strong

[11] Patent Number: 5,553,399

[45] **Date of Patent: *Sep. 10, 1996**

[54] LIGHTWEIGHT FOOTWEAR ARTICLE PROVIDING IMPROVED TRACTION

[76] Inventor: Molly Strong, P.O. Box 1425, Bigfork, Mont. 59911

[ * ] Notice: The term of this patent shall not extend beyond the expiration date of Pat. No. 5,150,536.

[21] Appl. No.: 337,963

[22] Filed: Nov. 14, 1994

Related U.S. Application Data

[63] Continuation of Ser. No. 952,947, Sep. 28, 1992, abandoned, which is a continuation-in-part of Ser. No. 462,637, Jan. 9, 1990, Pat. No. 5,150,536.

[51] Int. Cl.[6] ..... A43B 1/02; A43B 3/16; A43C 15/06

[52] U.S. Cl. ..... 36/9 R; 36/7.1 R; 36/7.6; 36/59 C; 36/44

[58] Field of Search ..... 36/110, 7.1 R, 36/7.2, 7.7, 7.6, 59 C, 9 R, 44

[56] References Cited

U.S. PATENT DOCUMENTS

| | | | |
|---|---|---|---|
| Re. 32,506 | 9/1987 | Hightower, Jr. | 36/2 |
| 126,450 | 5/1872 | Brown | 36/9 R |
| 205,837 | 7/1878 | Chase | 36/15 |
| 371,270 | 10/1887 | Maxwell | 36/7.1 R |
| 384,155 | 6/1888 | Hathorn | 36/138 |
| 387,035 | 7/1888 | Basch | 36/8.1 |
| 476,499 | 6/1892 | Trimby | 36/44 |
| 1,018,415 | 2/1912 | Weir | 36/15 |
| 1,228,720 | 6/1917 | Troutt | 36/15 |
| 1,335,287 | 3/1920 | Lundin et al. | 36/9 R X |
| 1,644,217 | 10/1927 | Wreford | 36/7.1 |
| 1,803,554 | 5/1931 | Knilans | 36/9 R X |
| 2,435,668 | 2/1948 | Behringer et al. | 36/15 |
| 2,586,045 | 2/1952 | Hoza | 36/9 R |
| 2,598,217 | 5/1952 | Bronson | 36/9 R X |
| 2,679,117 | 5/1954 | Reed | 36/9 R |
| 2,680,309 | 6/1954 | Peterson | 36/15 |
| 2,685,141 | 8/1954 | Davenport | 36/7.6 |
| 2,718,715 | 9/1955 | Spilman | 36/11 |
| 2,721,399 | 10/1955 | Emmer | 36/7.1 |
| 2,799,951 | 7/1957 | Rogers | 36/7.1 |
| 3,084,459 | 4/1963 | Colman | 36/7.1 |
| 3,208,164 | 9/1965 | Hoyt, Jr. | 36/7.1 |
| 3,574,958 | 4/1971 | Martuch | 36/84 |
| 3,724,105 | 4/1973 | Weight | 36/44 |
| 3,736,673 | 6/1973 | Dubner | 36/44 |
| 3,863,272 | 2/1975 | Guille | 36/12 |
| 3,968,577 | 7/1976 | Jackson | 36/43 |
| 4,023,281 | 5/1977 | Terry | 36/7.1 |
| 4,062,131 | 12/1977 | Hsiung | 36/44 |
| 4,130,948 | 12/1978 | Krug | 36/44 |
| 4,187,621 | 2/1980 | Cohen | 36/44 |
| 4,217,704 | 8/1980 | Whitaker | 36/7.1 |
| 4,359,783 | 11/1982 | Andrews | 36/4 |
| 4,461,098 | 7/1984 | Diegelman | 36/7.1 |
| 4,461,099 | 7/1984 | Bailly | 36/44 |
| 4,489,510 | 12/1984 | Williams | 36/7.6 |
| 4,516,336 | 5/1985 | Nissenbaum | 36/7.1 |
| 4,597,196 | 7/1986 | Brown | 36/44 |
| 4,616,428 | 10/1986 | Leger | 36/7.1 |
| 4,619,058 | 10/1986 | Gumbert | 36/102 |
| 4,642,912 | 2/1987 | Wildman et al. | 36/44 |
| 4,649,586 | 3/1987 | Wu | 36/44 |
| 4,713,895 | 12/1987 | Vallieres | 36/7.1 |
| 4,782,605 | 11/1988 | Chapnick | 36/44 |
| 4,896,437 | 1/1990 | Johnson | 36/1.5 |
| 4,984,377 | 1/1991 | Schneider | 36/67 |
| 5,150,536 | 9/1992 | Strong | 36/7.1 R |

FOREIGN PATENT DOCUMENTS

| | | | |
|---|---|---|---|
| 0063327 | 2/1914 | Germany | 36/7.1 R |
| 1156907 | 7/1969 | United Kingdom | 36/7.1 R |

*Primary Examiner*—Ted Kavanaugh
*Attorney, Agent, or Firm*—Christensen, O'Connor, Johnson & Kindness PLLC

[57] ABSTRACT

A lightweight footwear article (100) providing improved traction has a sole (101) having a ground contact surface that has an area somewhat oversized in contrast to the foot of a wearer and constructed of a pliable, breathable, machine-washable fibrous material which provides good traction on slippery surfaces. The footwear article (100) may also have a removable, contoured, cushioned insole (102). Moreover, the footwear article (100) may have an upper (104) made of a lightweight, breathable, machine-washable material.

33 Claims, 19 Drawing Sheets

LIGHTWEIGHT FOOTWEAR ARTICLE PROVIDING IMPROVED TRACTION

CROSS-REFERENCES

This application is a continuation application based on prior application Ser. No. 07/952,947, filed on Sep. 28, 1992, now abandoned, which in turn is a continuation-in-part of U.S. patent application Ser. No. 07/462,637, filed Jan. 9, 1990, now U.S. Pat. No. 5,150,536.

FIELD OF THE INVENTION

The present invention relates to a footwear article, and more particularly to a lightweight footwear article providing improved traction, comfort, and warmth to the foot of a wearer.

BACKGROUND OF THE INVENTION

Footwear articles designed for wear on slippery surfaces such as wet ground, snow, or ice typically are provided with soles made of hard, heavy, waterproof material, e.g., rubber or plastic, and having treads, studs, spikes, or the like on the bottom thereof to improve traction on slippery surfaces. For example, U.S. Pat. No. 4,516,336 to Nissenbaum describes a footwear article plastic sole with a ribbed or toughened contact surface.

The uppers of known footwear articles designed for wear on slippery surfaces commonly are made of rubber, leather, or vinyl. As a result of the types of materials used to make them, these footwear articles tend to be heavy. Moreover, it has been found that many of these footwear articles do not provide adequate traction on slippery surfaces.

The use of hard rubber, leather, or vinyl in footwear also has disadvantages in insulating the foot of the wearer and keeping it warm. Since these materials are not breathable, heat, moisture, and salt from sweat generated by the foot of the wearer tend to be trapped in the footwear article. The sweat, composed of water, oils, minerals and salt, conduct body heat out of the footwear article, resulting in cold feet. This tends to make the entire body of the wearer feel colder.

It is also known to use soft, fibrous materials for footwear soles. For example, U.S. Pat. No. 4,217,704 to Whitaker describes an overshoe for wear when cleaning floors, having a sole made of non-woven synthetic fibers and an upper made of an elastomeric material such as rubber. U.S. Pat. No. 4,489,510 to Williams describes a shoe slipper for wear when cleaning floors, having a sole made of fibrous pads and an upper made of plastic. However, these footwear articles do not provide adequate breathability. Moreover, traction and comfort can be improved. Also, these footwear articles are not machine-washable nor are they used for snow and ice conditions.

U.S. Pat. No. 2,685,141 to Davenport describes a metallic, steel wool-type material for use as a sole attachment to provide traction on ice and snow. This material has weight, insulation, corrosion, and safety disadvantages.

It is also known to use leather as a sole material for footwear articles. For example, U.S. Pat. No. 2,718,715 describes a pac having a leather sole. Since leather is a relatively expensive material, products made of leather are relatively costly. Moreover, the use of leather as a footwear material is objectionable to those who disfavor products derived from animals. Also, leather is not thermally insulating, regardless if the leather is wet, dry or oiled.

A comfortable, lightweight footwear article providing improved traction is desirable. Lightness of weight allows for freedom and agility to quickly respond to hazards and changes in winter conditions during walking or climbing. Moreover, for wear in cold weather, a footwear article also having improved insulation is desirable. Furthermore, a footwear article that is machine-washable is desirable.

SUMMARY OF THE INVENTION

The present invention provides a comfortable, lightweight footwear article having improved traction. The footwear article is specially adapted for wear on slippery surfaces, e.g., on wet ground or on snow or ice. More specifically, the footwear article of the present invention has a sole made of a fibrous material that provides excellent traction over slippery surfaces. Also, in the preferred embodiment, the footwear article has a lightweight, breathable upper. The upper may be adapted for the particular use of the footwear article. For example, a winter boot may have a calf-length, fleece upper, while a summer shoe may have an ankle-high upper composed of thin, net material. The footwear article may be configured as a closed-toe shoe, boot, overshoe, sandal, etc.

The footwear article of the present invention is provided with an oversized sole for greater surface contact, improved traction, and increased comfort. Also, the footwear article may be provided with an oversized cushioned insole. An embodiment designed for use m cold weather also provides good thermal insulation and warmth due to the breathability of materials used in its construction. Further, the footwear article is lightweight and machine-washable.

When a wearer applies weight to a bare foot, e.g., as in walking, the foot naturally spreads. A typical footwear article has a relatively narrow width in comparison to a foot, and does not properly fit the foot. The narrow width inhibits spreading of the foot. This usually causes discomfort, reduced flexibility and traction, and may well cause a variety of health problems. Constriction of the spreading of the foot severely limits the function of all the components of the foot, especially circulation. It also inhibits proper function of the nerve, muscle, tendon, ligament and bone functions as they relate to one another. The footwear article in accordance with the present invention does not inhibit the natural spread of a foot when the wearer applies weight to the foot.

The inventor has discovered, contrary to the belief in the art, that a footwear article having a pliable, breathable, fibrous sole surface is advantageous in providing good traction on slippery surfaces such as snow or ice and provides warmth in cold conditions. The sole is secured to the foot, boot, or shoe of a wearer such that it covers the entire bottom of the foot, boot, or shoe and may also extend up the sides, toe and heel to some extent. The extension of the sole up the sides, heel and toe provides sole material to contact the ground when the ground is uneven or the wearer takes uneven steps.

In a further embodiment of the invention the footwear article includes an insole positioned above the sole piece. The insole is composed of a layer or multiple layers of closed-cell foam shock absorption and/or thermal insulation materials. The pliability of the sole material coupled with the softness of the insole, relative to a hard rubber material gives the overall impression of a large padded paw and gives the footwear article better traction through higher surface area of ground contact. The softness feature allows the sole of the footwear article to mold and conform around irregularities on the ground surface, such as rocks or ice chunks, so that contact of the sole with the ground is not lost. Further, the insole and sole spread out to some extent when stepped on to provide an even higher surface area of contact.

The insole further provides insulation for the wearer's foot from the cold of the ground surface. The closed-cell foam materials used to construct the insole may be chosen to prevent the moisture in the sole material from transferring to the foot or to allow moisture to seep into the interior of the footwear article. If water should collect in the foam insole, no substantial heat loss occurs. Body heat is held in by the foam insole to heat the water and start to evaporate it. The wet footwear article stays warm as it dries.

Further, the insole provides padding for the foot for support and comfort. By the use of various layers of foam of varying thickness and density, as well as an optional cork insert and/or soft material layer and/or arch or heel inserts the comfort feature can be adjusted. Also, "off the shelf" or prescription orthopedics could be used in place of portions of the insole or integrated into the insole.

Another feature of the insole is the lack of an external raised heel portion. Without a raised heel, the footwear article allows "flatter" walking, i.e., less heel-to-toe walking. Better traction is obtained by flatter walking because more surface area of the sole is in contact with the ground for a longer time. The concentration of pressure in a small area (ball of the foot) which occurs in heel-to-toe walking is reduced to some extent by the absence of a raised heel. Also, without heel elevation, the body weight is more evenly distributed in walking as well as when standing still, resulting in less stress and better balance. Also, the whole body does not have to compensate for always being tipped forward.

The footwear article may further include an upper to cover the foot and, optionally, the ankle and/or a portion of the leg of the wearer. The upper may extend to any height and even serve as a portion of a body garment. The upper can be made of any of a multitude of conventional materials. The major requirement for the upper material is that it have the property of breathability so that moisture is not trapped in the footwear article. Moisture trapped in the footwear article will reduce its insulating ability and make the foot of the wearer colder. Examples of suitable materials for the upper include polar fleece, nylon pack fabric, wool, cotton, and any combinations of the above.

The upper may be permanently attached to the sole piece or it may be detachable from the sole piece. If the upper is attached to the sole piece, it is attached around the entire periphery of the sole piece which extends up the sides, heel, and toe of the footwear article. This can be accomplished by sewing the upper and the sole piece to an elastic strap or two elastic straps overlapping each other which extend around the entire circumferential edge of the sole piece. The upper can also be sewn directly to the sole piece on its inner surface around the entire circumferential edge. The attachment of the upper to the sole piece also aids in positioning the sole piece around the sides, heel and toe of the footwear. The sole piece thus extends in a rounded fashion from the surface of the sole piece which normally contacts the ground to the point of contact with the upper. The placement and oversize of the insole also aid in forming a rounded and extending structure over which the sole piece is placed, as indicated above.

As noted above, the upper may be removable from the sole piece. To this end, the upper includes a sock portion covering the wearer's foot, with the top of the sock portion extendable to different heights as low as the ankle, up to the calf, higher over the knee or even the full length of the legs to form pants or trousers with integral feet. Further, the upper may actually serve as part of a full body suit. A layer of rubber or felt or felt-like material (for indoor and/or outdoor use), may be applied to the bottom of the foot portion of the removable upper. Further, a fitted foam insole may be employed within the sock portion of the upper for increased foot support. It will be appreciated that in this aspect of the present invention, several different uppers may be used in conjunction with the singular sole piece. This permits the uppers to be of various materials, colors and heights, without the expense of a separate sole piece for each upper. Moreover, if the sole piece is soiled from being worn outside, the dirt, etc. need not be tracked indoors. Further, for the uppers having a layer of felt or rubber underneath the sock portion, the upper can be worn outside to a limited extent.

The upper is held to the foot, ankle, and/or leg of the wearer using conventional fastening means which preferably are adjustable. One example of a suitable fastening method is the use of elastic straps to extend around the upper. Alternatively, Velcro® fasteners, snaps, drawstrings with fasteners, laces, zippers, buckles, and combinations thereof can be used. The fastening means could be on the outside, or totally or partially on the inside, of the footwear article. Further, the upper may be lined with any conventional type of breathable insulating material. As a further alternative fastening method, the upper may be lined with an elastic material to hold the upper in place.

The footwear article, and hence the sole, may be secured to the foot worn over a shoe or over the sock portion of a removable upper in numerous ways, for instance, by using elastic straps, Velcro® hooks and loops fasteners, snaps, drawstrings with fastening devices, laces, zippers, buckles, etc., and combinations of the above. For example, the footwear article can be secured in place by the use of an elastic strap sewn around the circumferential edge of the sole. The elastic strap may be stretched to fit over the foot, shoe, or boot, and tightens around the foot, shoe, or boot when the stretching pressure is released. An adjustability feature can be added which consists of a strap around the back of the heel that is sewn to the circumferential elastic strap on each side of the heel and fastened at varying tightnesses. Moreover, the sole may be secured by means of a drawstring threaded through holes in the circumferential edge of the sole which can be adjusted with a fastener connected to both ends of the drawstring. Further, elastic straps or other fastenable straps, e.g., Velcro® hooks and loops fasteners could extend from one side of the sole to the other over the top of the foot, shoe, or boot, to hold it in place.

Particularly, a unitary nylon strap which has Velcro® loops on its surface at one end and hooks on its opposing surface at the other end can be sewn underneath the above-discussed circumferential elastic strap, only around the heel area. The nylon strap which contains the Velcro® hooks and loops fasteners pass through D-rings or loops sewn or otherwise attached to the edge of the sole piece underneath the circumferential elastic strap on either side of the ankle portion of the footwear article. The ends of the nylon strap, which have the Velcro® hooks and loop areas on them, extend from underneath the elastic strap and over and across the top of the ankle portion of the footwear article such that they can be adjustably fastened to one another to secure the footwear article to the ankle of the wearer and also to tighten the footwear article over the heel of the wearer.

The footwear article may be secured to the foot, shoe, boot or removable upper worn by the wearer by an alternative construction whereby the nylon cross-straps are replaced with a stretchable mesh material covering the top of the sole piece. The perimeter of the mesh material can be sewn to the perimeter of the sole piece, with an expandable hole formed in the stretchable mesh material for reception of the foot. As an option, a slide fastener may extend forwardly from the foot opening toward the toe to facilitate entry of the foot, shoe or boot into the sole piece and removal therefrom.

A further feature of the invention is that all of the materials in combination result in a lightweight footwear article. The lightweight feature aids in the comfort of the footwear and also aids in its traction properties because less force is exerted onto the slippery surface.

Also, the footwear article is easily washable, in a washing machine or otherwise, because of the porosity and light weight of the materials used in its construction. If the footwear article includes an insole, this is preferably, but not necessarily, removed before washing and slipped back into position after drying.

BRIEF DESCRIPTION OF THE DRAWINGS

The invention will be described with reference to the accompanying drawings, wherein.

DETAILED DESCRIPTION OF THE PREFERRED EMBODIMENTS

Figure 1:
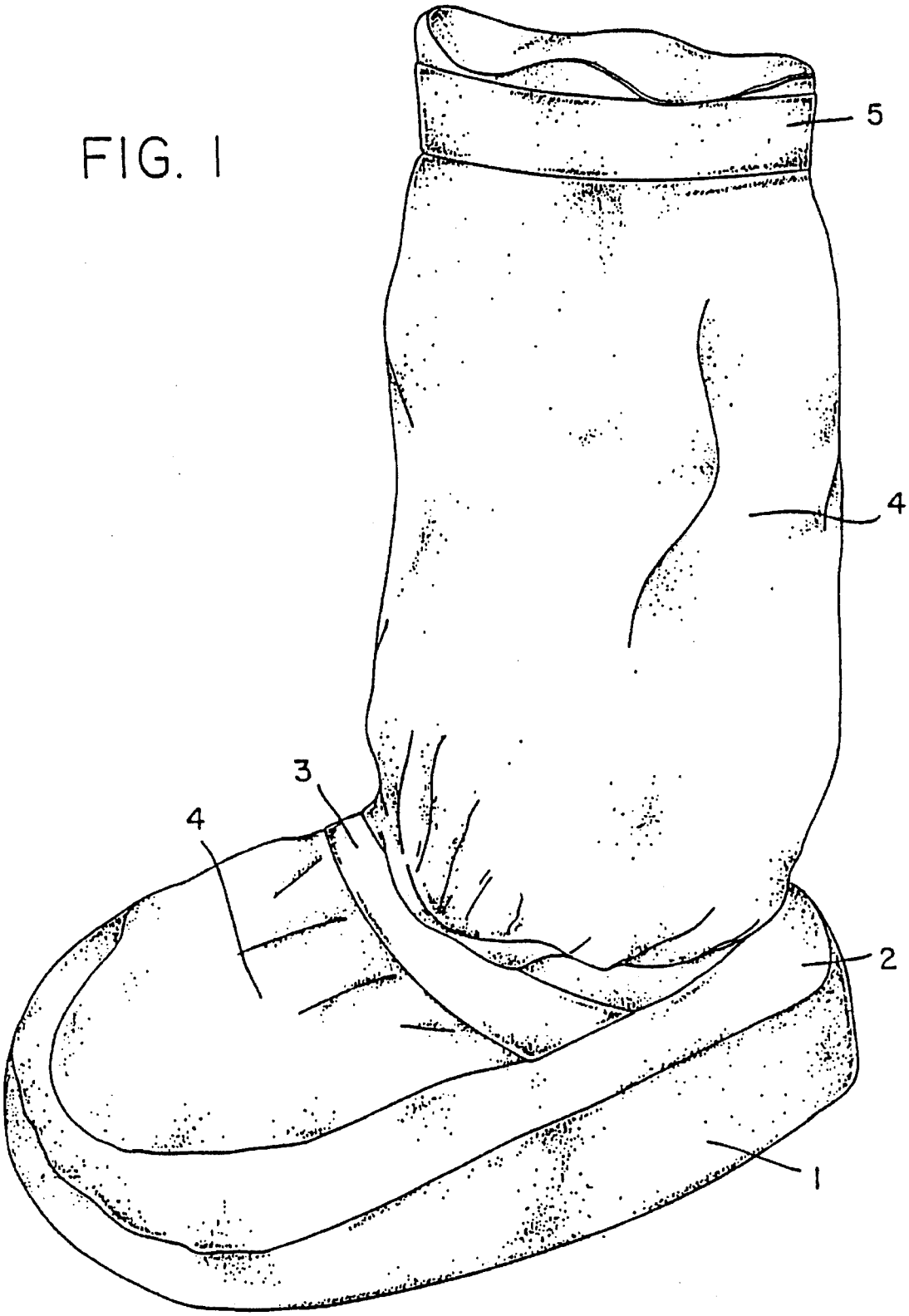
FIG. 1 is a perspective view of one embodiment of a footwear article in accordance with the present invention.

FIG. 1 shows one embodiment of a footwear article in accordance with the present invention which consists of a unitary sole piece 1 connected to an upper 4 by means of sewing both the sole piece 1 and the upper 4 to an elastic strap 2 which extends around the entire circumferential edge of the footwear article. It is to be understood that rather than by sewing, these components can be assembled together by other methods such as by fusing or bonding such as with an adhesive. The footwear article illustrated also includes an elastic strap 3 which extends from the circumferential edge of the sole piece 1 under the circumferential elastic strap 2 on one side to the circumferential edge of the sole piece 1 under the circumferential elastic strap 2 on the other side. The elastic strap 3 extends over the ankle of the wearer to hold the foot into the footwear article. The footwear article illustrated also includes an elastic strap 5 around the circumference of the top of the upper 4 which holds the upper 4 onto the leg of the wearer.

Figure 2:
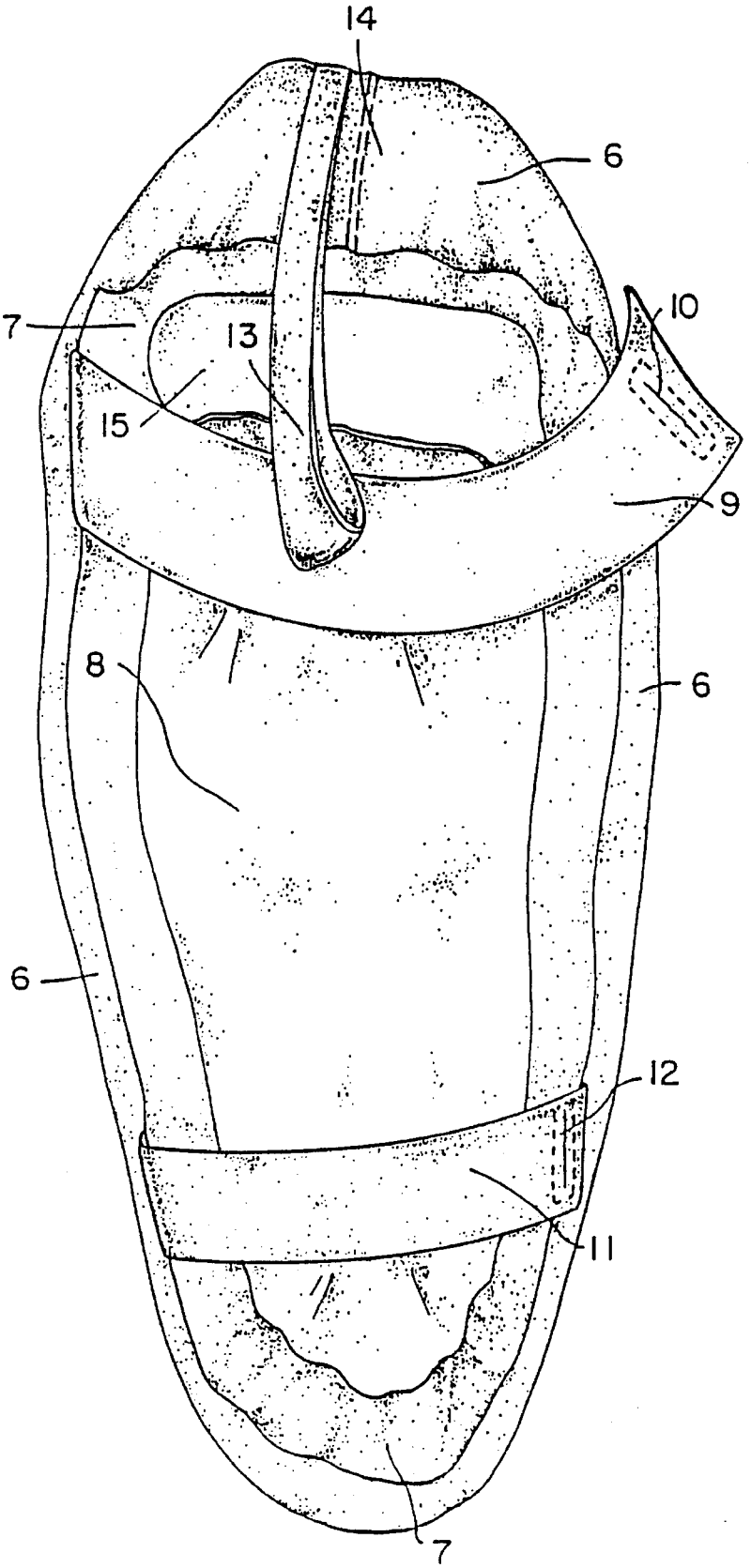
FIG. 2 is a top view of another embodiment of a footwear article in accordance with the present invention.

FIG. 2 is a top view of another embodiment of a footwear article in accordance with the present invention. A unitary sole piece 6 which extends around from the bottom surface is connected to an elastic strap 7 which extends around the circumferential edge of the sole piece 6, which is in turn attached to the upper 8. A strap 9, having a Velcro® hooks and loops fastener 10 extends from one side of the footwear article to the other, over the ankle area of the wearer. A second strap 11, with Velcro® hooks and loops fastener 12, extends from one side of the footwear article to the other over the toe area of the wearer. A strap doubled back and attached to itself and the heel area of the sole piece forms a loop 13 for pulling the footwear article on. A seam 14, where the unitary sole piece 6 is cut and gathered around the heel extends up the back of the heel. The cavity 15 for the foot of the wearer is formed by the sole piece 6, elastic strap 7, and upper 8.

Figure 3:
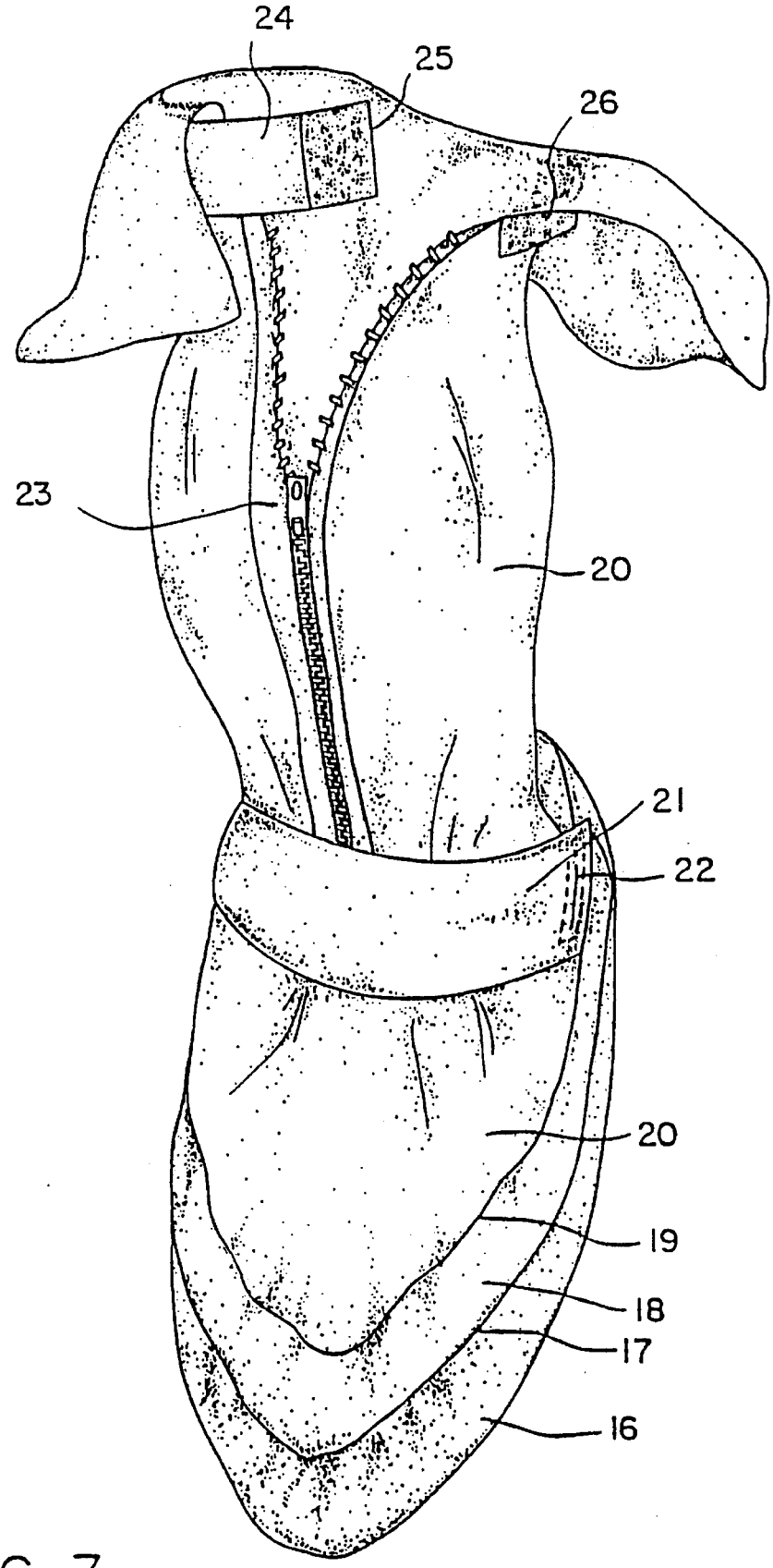
FIG. 3 is a view of another embodiment of a footwear article in accordance with the present invention.

FIG. 3 shows another embodiment of a footwear article in accordance with the present invention. The footwear article has a unitary sole piece 16 sewn by a seam 17 to an elastic strap 18 which is sewn by a seam 19 to an upper 20. The footwear article has a strap 21 extending from one side of the article to the other and fastened by Velcro® hooks and loops fasteners 22. The top part of the upper 20 is openable via a zipper 23 and is secured around the leg of the wearer by a strap 24 having Velcro® hooks 25 on one end and Velcro® loops 26 on the other end.

Figure 4:
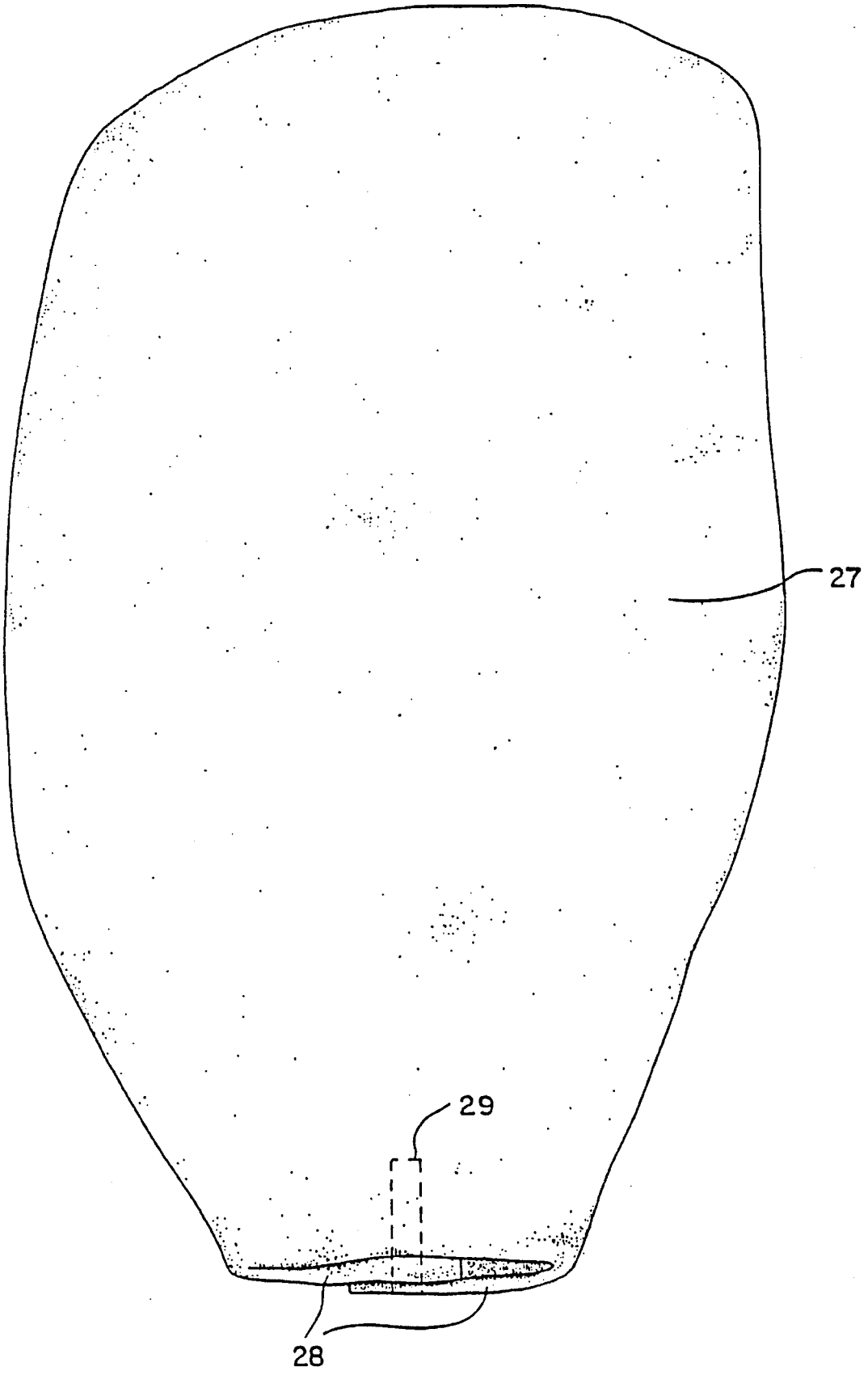
FIG. 4 is a bottom view of a footwear article in accordance with the present invention, generally showing construction of the sole.

FIG. 4 shows the bottom of a footwear article in accordance with the present invention. The footwear article has a unitary sole piece 27 that is flat on the bottom and oversized in relation to the shape of the foot of the wearer. The unitary sole piece 27 is cut to form flaps 28 which are sewn together along seams 29, which extend up the back of the heel, to form a heel portion of the sole piece 27.

Figure 5:
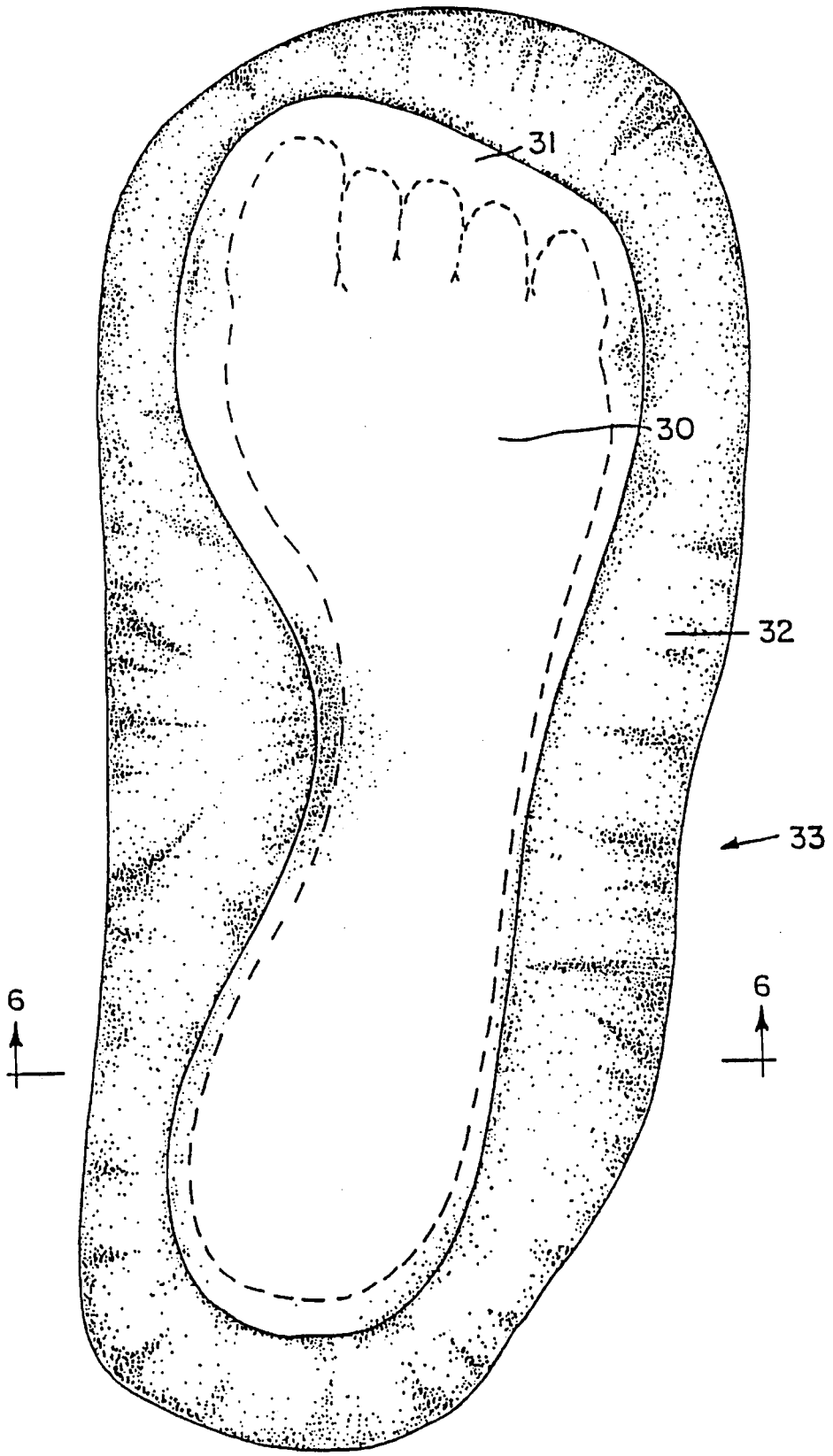
FIG. 5 is a top view of an insole to be placed inside the footwear article in accordance with the present invention.

FIG. 5 shows the top of an insole used in a footwear article in accordance with the present invention. The insole has an indented portion 31 roughly in the form and size of the foot 30 of the wearer and an oversized insole 33 which has an extended portion 32 beyond the area of the foot 30 of the wearer. The indented portion 31 is formed within the sloping extended portion 32 of the insole.

Figure 6:
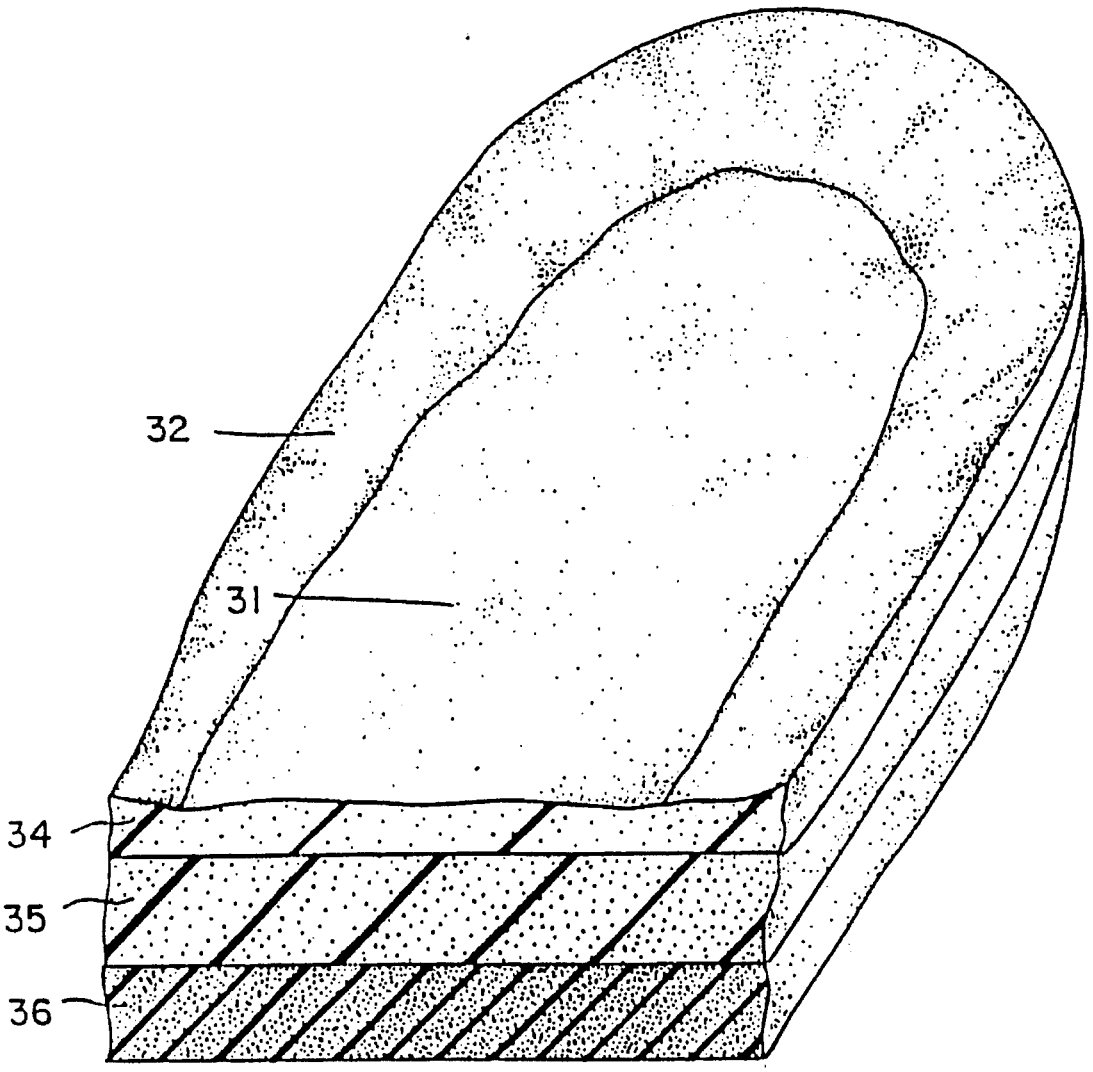
FIG. 6 is a cut-away view of the insole along line 6—6 of FIG. 5, showing the layers of the insole.

FIG. 6 is a cut-away view of the insole along line 6—6 in FIG. 5, showing the indented portion 31 and the sloping and extending portion 32 of the insole. The insole, as illustrated, has three layers. The top layer 34 is a thin layer of pressed felt or other soft material or a molded thin-formed cork insert. It should be noted that the surface of the indented portion 31 and the sloping and extended portion 32 are a unitary surface which surface is the top layer 34. The middle layer 35 and the bottom layer 36 of the insole are composed of closed-cell foam material. Preferably, the closed-cell foam material of the middle layer 35 is less dense than the closed-cell foam material of the bottom layer 36.

Figure 7:
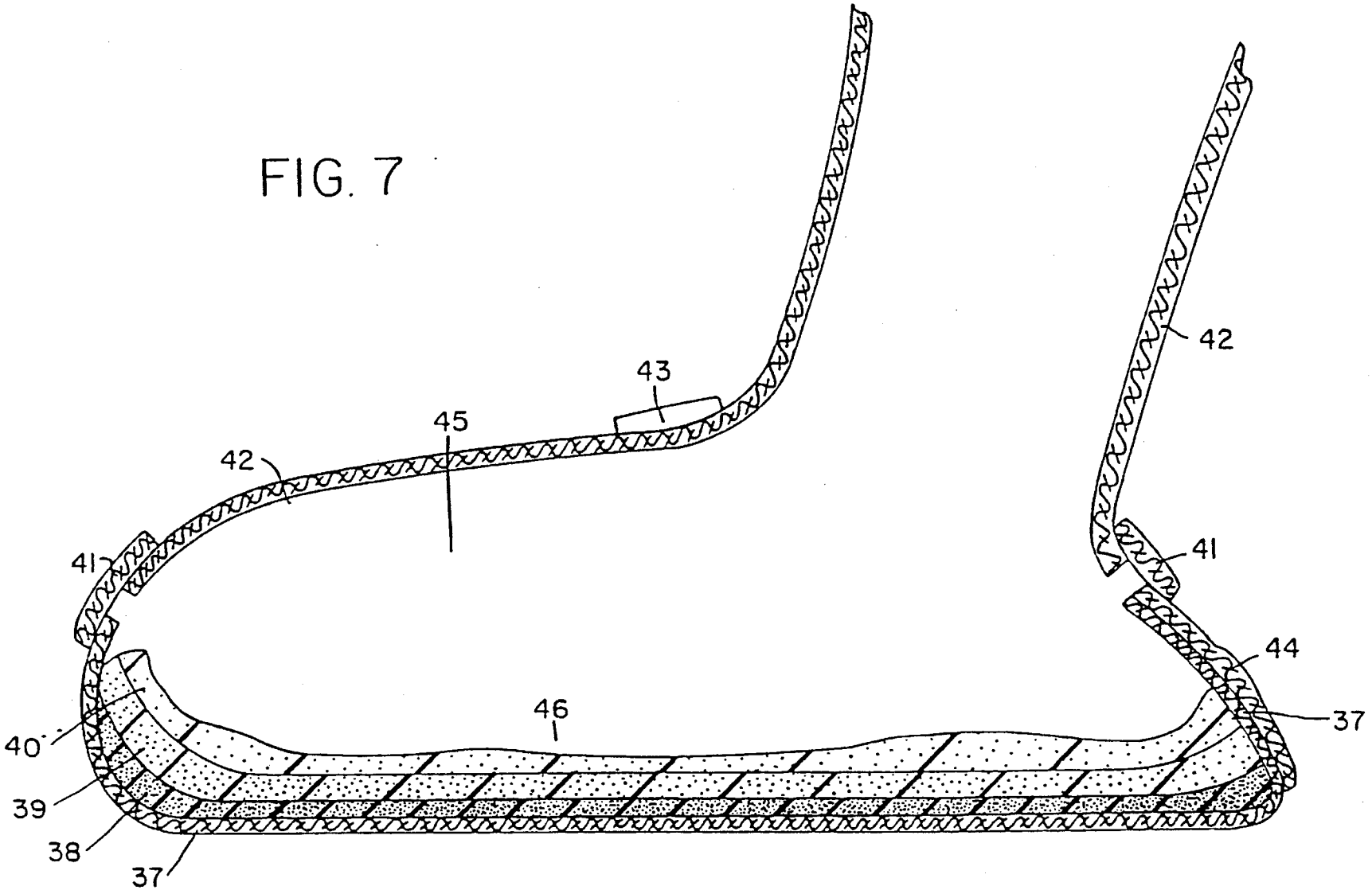
FIG. 7 is a cut-away side view of one embodiment of a footwear article in accordance with the present invention, showing the layered insole and the upper.

FIG. 7 shows a cut-away side view of an embodiment of a footwear article in accordance with the present invention. The unitary sole piece 37 is flat on the bottom and extends up the toe and heel. The heel portion has a flap 44 which is part of the unitary sole piece 37, but has been cut and folded over to create an extended heel portion. The top, middle and bottom layers of the insole 40, 39, and 38, respectively, are positioned on the sole piece 37. The indented portion 46 of the insole for the foot of the wearer does not extend to the end of the insole as a whole either at the heel or toe. An elastic strap 41 is attached to the sole piece 37 around its entire circumferential edge and is also attached to the upper 42 so that the upper 42 and sole piece 37 are connected. The strap 43 over the ankle portion holds the foot of the wearer in the footwear article. The cavity 45 formed by the sole piece 37, insole, and upper 42 is for the foot, boot, or shoe of the wearer.

Figure 8:
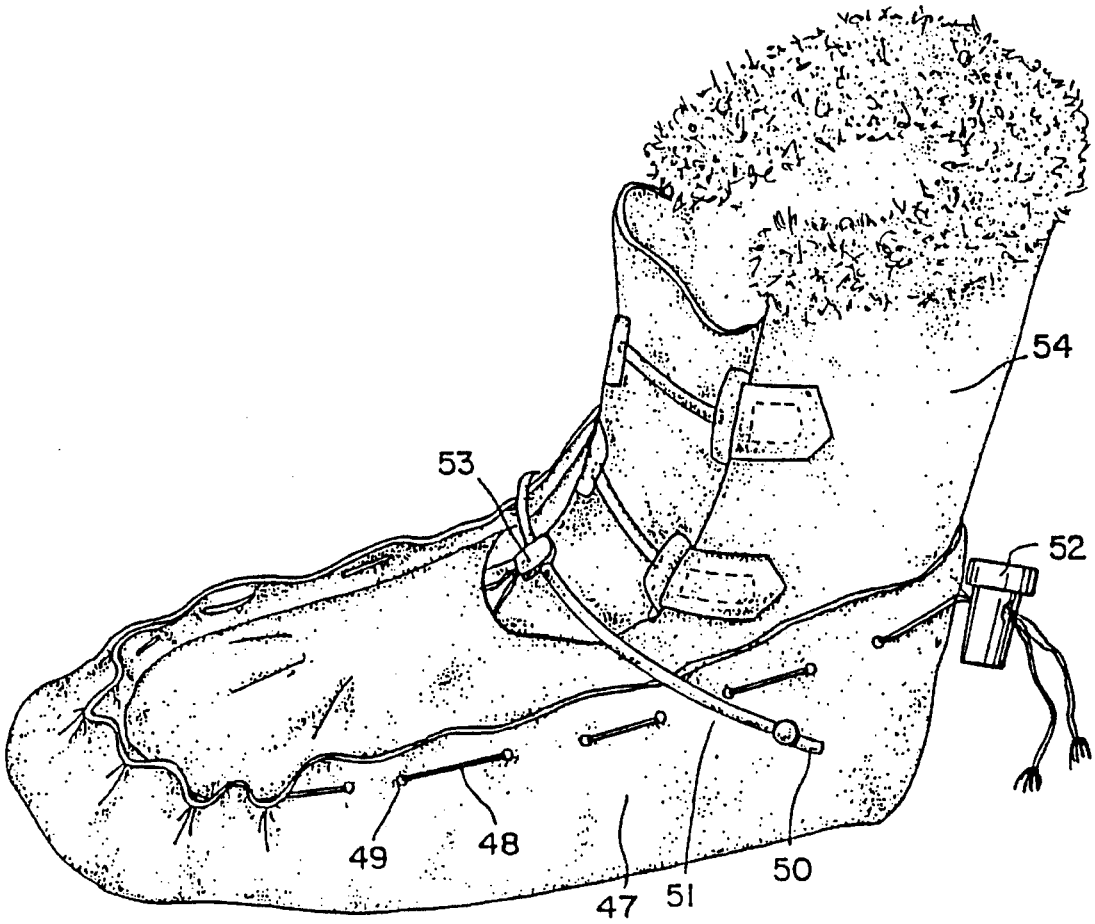
FIG. 8 is a perspective view of an overboot embodiment of the footwear article of the present invention, used in conjunction with a shoe.

FIG. 8 illustrates an embodiment of the invention in which the footwear article has no insole or upper. The footwear article illustrated consists of a unitary sole piece 47 secured to an existing boot 54 (not part of the invention) by means of a drawstring 48 threaded around the circumferential edge of the sole piece 47 through holes 49. The ends of the drawstring 48 are gathered in a barrel tension clip 52 by which it can be adjusted. Further, a rivet and clip 50 is attached to each side of the sole piece 47 through which a second drawstring 51 is passed. The second drawstring is adjusted by adjuster 53.

Figure 9:
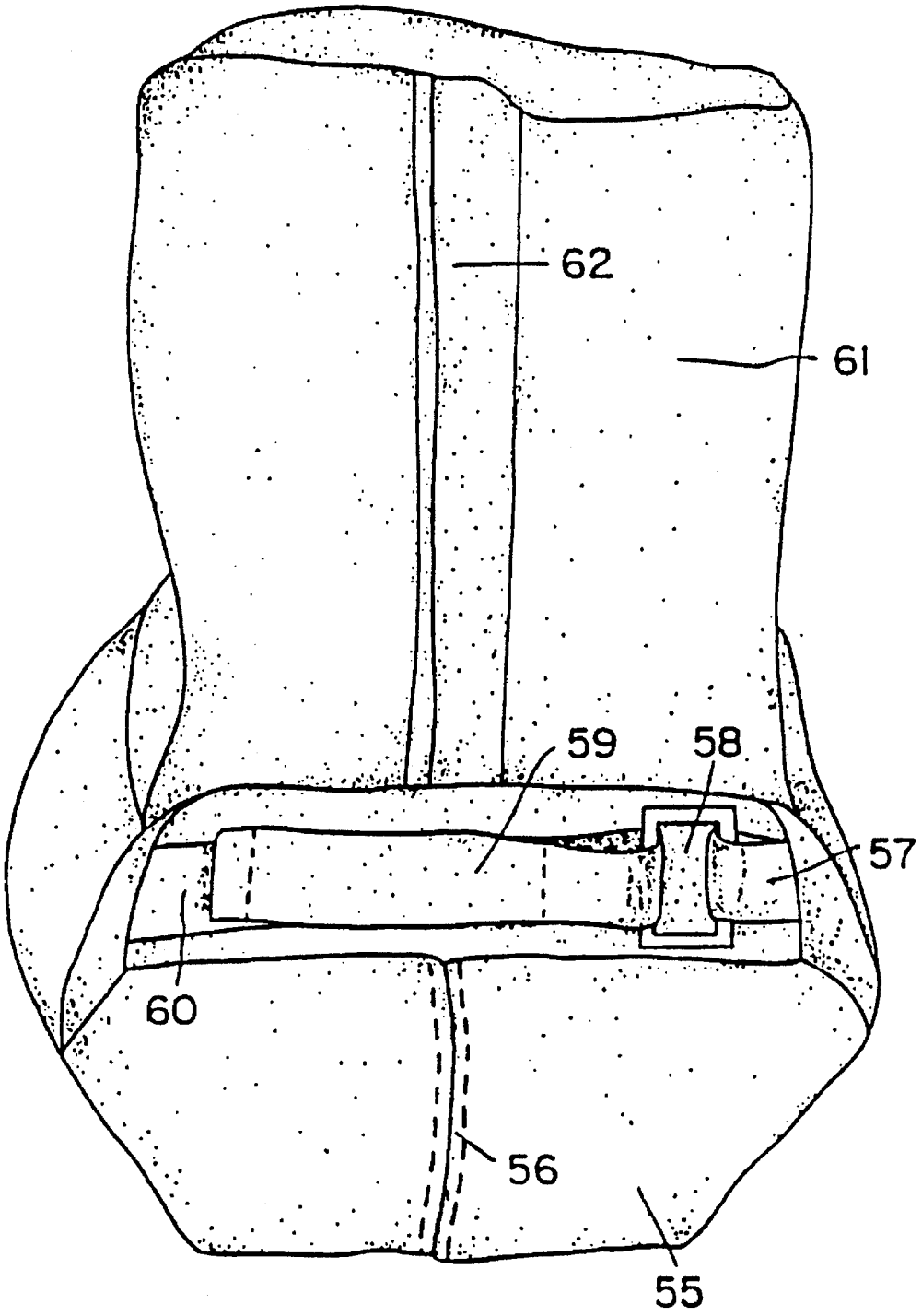
FIG. 9 is a rear view of an embodiment of the footwear article in accordance with the present invention, having an adjustable heel strap.

FIG. 9 is a rear view of an embodiment of a footwear article in accordance with the present invention. This embodiment has a sole piece 55 and seam 56 formed by cutting a slot in the sole piece 55 and folding it over to form the heel portion. The footwear article has a means for tightening down the heel which consists of a strap 57 attached on one side of the heel and also attached to a D-ring 58. Another strap 60 attached to the other side of the heel is slipped through the D-ring 58 and fastened back on itself by a Velcro® hooks and loops fastener 59. The seam 62 of the upper 61 is also illustrated.

Figure 10:
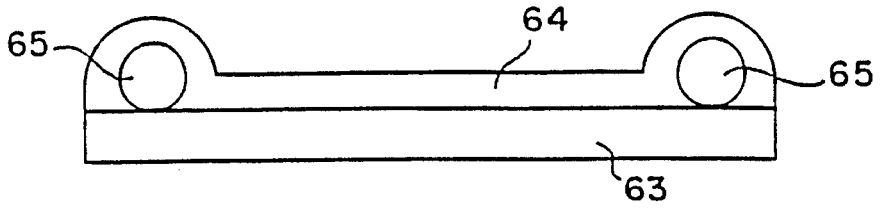
FIG. 10 is a cut-away view of an insole having plastic tubing that forms an indented portion for receipt of a foot.

FIG. 10 is a cut-away view of another embodiment of an insole. The insole has two-layers, a bottom layer 63 and a top layer 64. Secured between the bottom layer 63 and the top layer 64 is plastic tubing 65 which acts to raise the outer edge of the top layer 64 to form an indented portion for a foot of a wearer.

Figure 11:
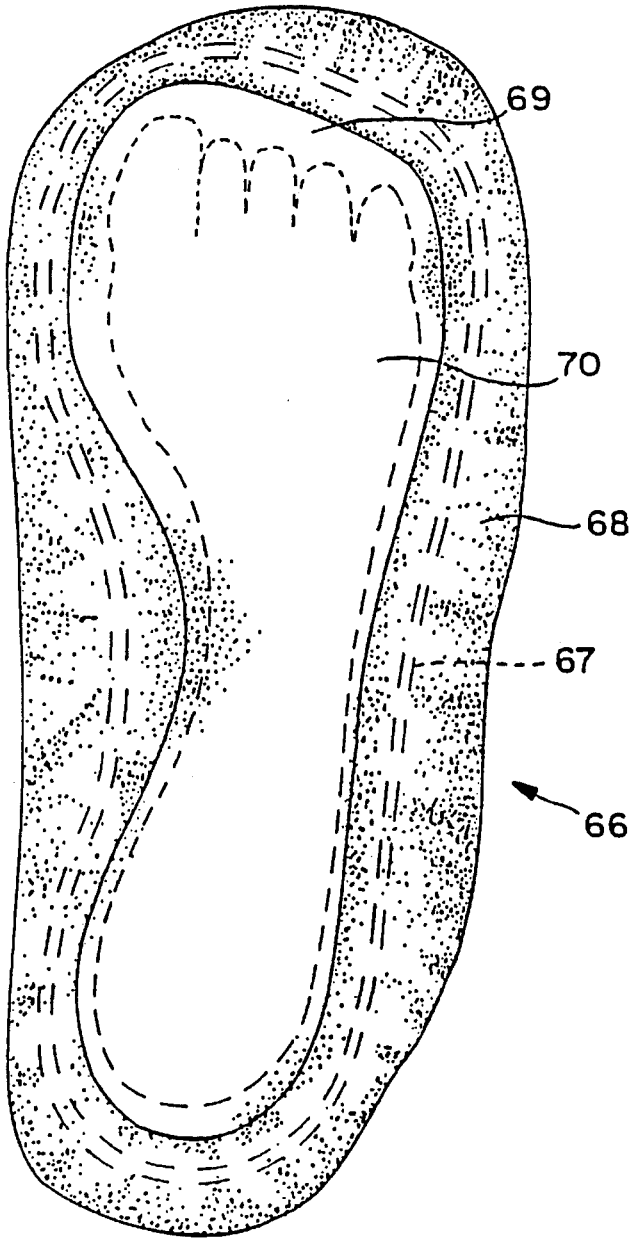
FIG. 11 is a top view of the insole shown in FIG. 10.

FIG. 11 is a top view of an insole 66 which has plastic tubing 67 underneath the top layer of the insole 66 to create a raised portion 68 of the insole 66 around the outer edge and an indented portion 69 for the foot 70 of the wearer.

Figure 12:
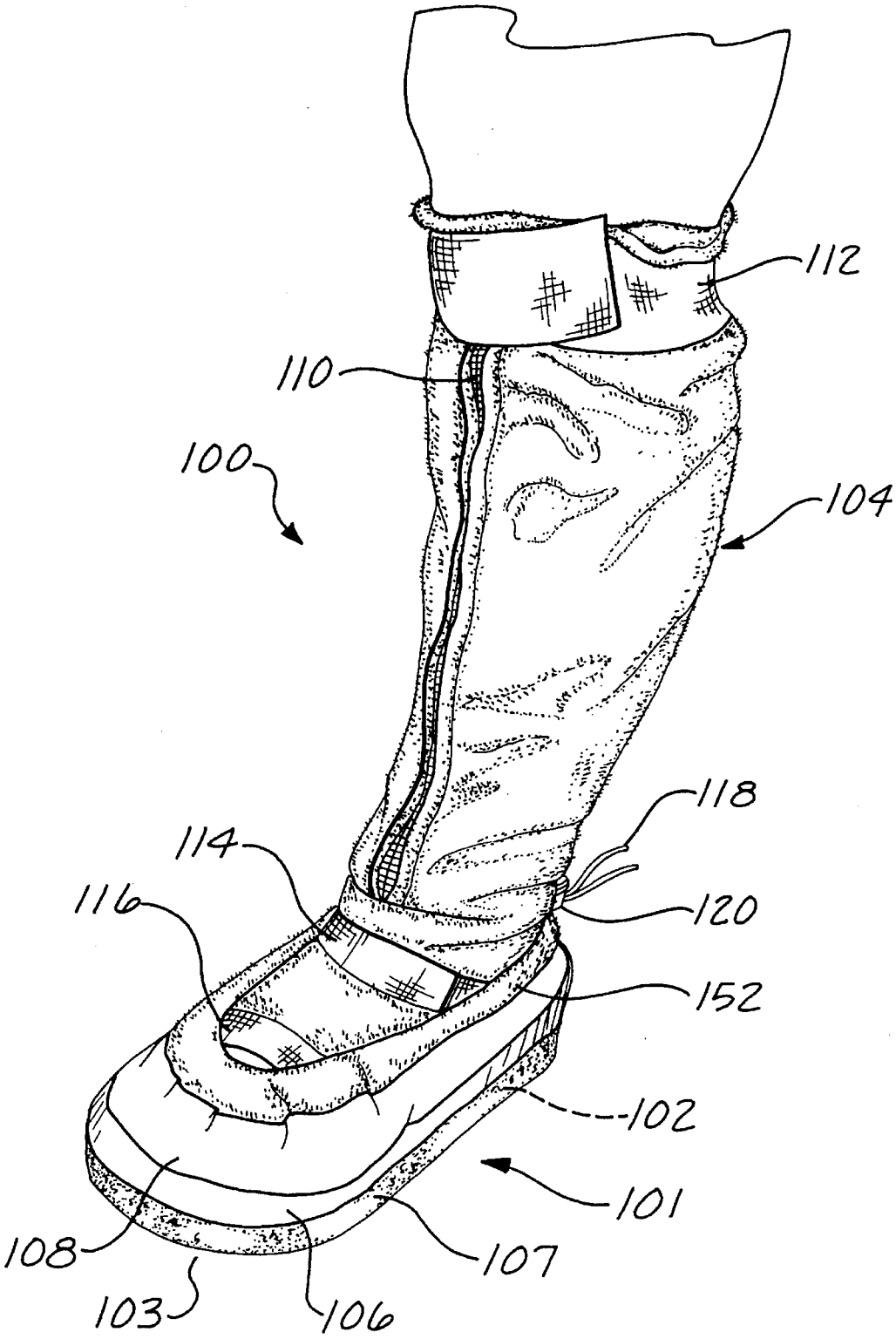
FIG. 12 is a perspective view of an alternative preferred embodiment of the footwear article in accordance with the present invention.
Figure 13:
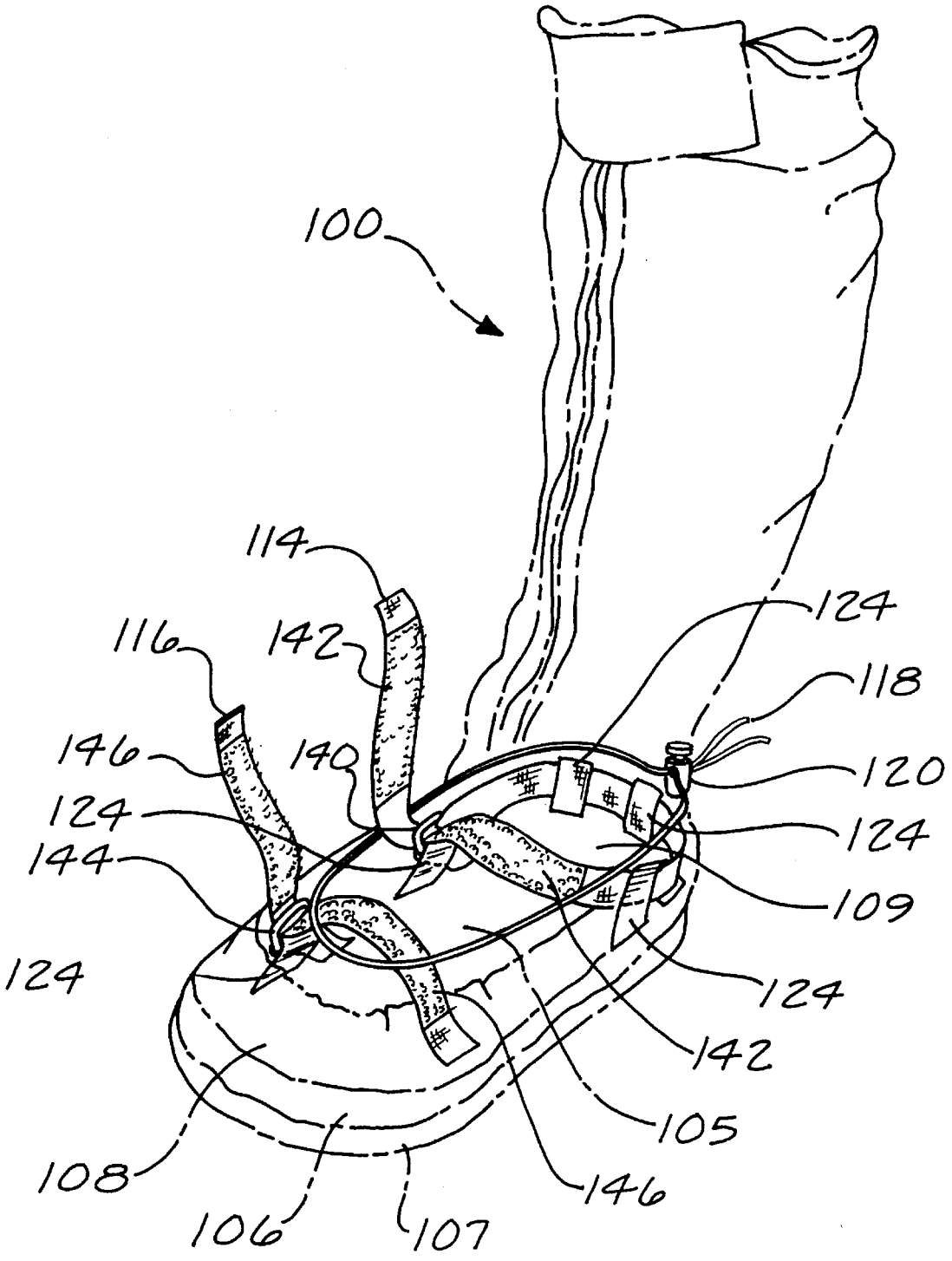
FIG. 13 is a view of the footwear article shown in FIG. 12, with the insole removed, the strapping system in solid view, and the outer sole and upper in phantom view.

Another embodiment of a footwear article in accordance with the present invention will be described generally with reference to FIGS. 12–14. This embodiment is especially suitable for wear in cold and wet conditions. FIG. 12 shows a boot 100 having a sole 101, an insole 102 and an upper 104. The sole 101 has a two-section out sole 103 in which a sole bottom part 105 (not visible in FIG. 12) has a substantially planar bottom surface for contacting the ground, and a second sole side part 107 extends upwardly from the sole bottom part 105 around the entire perimeter of the sole bottom part 105 to form a cavity 109 (FIG. 13). The bottom and side sole parts 105, 107 may be separate pieces that are joined together, e.g., by sewing or bonding, or the bottom and side sole parts 105, 107 may be of unitary composition.

The sole 101 also has lower intermediate and upper intermediate members 106 and 108, respectively. The lower intermediate member 106 extends around the out sole 103 and attached to the upper perimeter of the sole side part 107. The intermediate member 106 preferably is made of a washable, pliable, waterproof, or highly water-resistant, material that stops wicking of the sole to effectively help lighten the boot 100 when used in wet conditions. Vinyl or rubber materials, such as Truck-Tex® from Industrial Rubber, have been found to perform well. The upper intermediate member 108 extends around the out sole and is attached to the upper margin of lower intermediate member 106. Preferably, the upper intermediate member 108 is made of a washable, breathable, elastic material that may be stretched to facilitate putting on the boot 100 and returns to its unstretched state when released, to help hold the boot 100 to the wearer.

The upper 104 is shown as being calf-length and preferably is made of a washable, breathable, warm material, such as fleece. The lower edge of the upper 104 is attached at the seam or interface between the lower and upper intermediate members 106, 108. The upper 104 is provided with a slide fastener 110 along its height to facilitate putting on and taking off of the boot 100. An elastic strap 112 extends around the top of the upper 104 to hold the upper 104 to the calf of the wearer. A Velcro® fastener is provided for joining the adjustable free end of the strap 112 to a fixed portion of the strap 112. Also, a strap 114 holds the boot 100 at the ankle of the wearer, and a strap 116 holds the boot 100 near the toe area of the boot 100. The boot 100 is also provided with a drawstring 118 that may be adjusted to fasten the boot 100 to the wearer by way of a barrel clip 120. The fastening system is described in detail later in this discussion with reference to FIG. 13. The boot 100 also has an insole 122 (FIG. 14) for receipt of a foot of a wearer.

The outsole 103 may be composed of a fibrous, porous, breathable material. The inventor has found that an outsole 103 made of a material generally known as "papermaker's wet felt" provides superior traction on slippery surfaces. One example of this material is AM Flex2™ felt made by Appleton Mills, Inc. of Appleton, Wis. It has been found that papermaker's wet felt having a two-layer scrim construction and two distinct machined directions on its surface is preferable. The thickness of the bottom part 105 of the outsole 103 preferably is in the range of 1/16 to 1/4 inch, and within this range, a thickness of 1/8 inch is preferred. Felt made of 100% nylon has been found to be preferable.

However, other types of felts may also be used to form the outsole 103. For example, the outsole 103 part may be composed of needle punched felt of numerous other fibers or fiber mixes, including nylon, rayon, polypropylene, Capilene™, Polartech™, wool and cotton. In addition to felts, numerous other natural or synthetic materials or combinations of materials may be used to form the outsole. Such materials are characterized as being flexible, pliable, stretch-resistance, substantially heat-resistance, substantially resistant to common chemicals (e.g. oil, gasoline, detergents), substantially resistant to the scrubbing action occurring during normal walking, and washable. In addition, such material is characterized as being fibrous, e.g., having a raised nap. The fibers of the sole material may be joined by numerous techniques, for example, felted, woven, knitted, pressed, laminated, or bonded in any fashion, including heat or chemical processing.

Papermaker's wet felt as well as the other felts and the other materials noted above have certain properties which make them desirable as sole material for use on slippery surfaces. Perhaps the most remarkable property is adherence to slippery winter walking surfaces, namely snow and ice. Another unique property is it's superior insulation. The traction properties of the material are not affected by soil, chemicals, petroleum products, detergents, or exposure to heat up to 160° F. Additionally, the "fabric" lends itself to ease in sewing and adhesive bonding. Abrasion due to normal winter walking conditions has proven negligible. Neither sharp ice formations, rough snow-packed edges, loose sharp gravel, nor gritty fine snow, sand, or salt crystals interfere with the gripping and thermal properties of the material. An even more remarkable characteristic shows itself when the fabric becomes moist or even soaking wet, which typifies a normal winter cycle of constant cooling and thawing. The non-slipping property of the material is in fact greatly increased when moisture due to thawing makes walking extremely hazardous.

It is believed that the superior traction properties of the papermaker's wet felt and the other preferred materials are derived from their porous nature and their flat, fibrous surface. This is in contrast to what was apparently believed in the art to be necessary for winter footwear, i.e., waterproof materials and treaded surfaces. The sole material used in the novel footwear actually collects snow and ice within its fibers while being used. The theory, by which the inventor does not intend to be bound, is that the snow and ice collected in the sole material adheres to the snow and ice on the ground surface when the footwear is stepped down on. The adherence of the snow and ice in the fibers of the sole material to the snow and ice on the ground creates a firm foothold. The principle on which this theory is based is that like materials attract each other and adhere well to each other. The present invention applies this principle to snow and ice to provide high traction footwear for winter weather.

The fibrous sole material could be impregnated with a synthetic, flexible foam or similar material. The foam would add durability to the sole while maintaining the flexibility of the sole. Also, snow and ice would still collect at the bottom of the sole to provide excellent traction on slippery surfaces. Foams for this purpose include styrene, polyethylene, copolymer, neoprene, hypalon, polypropylene, Styrofoam and nitrite. The impregnating material could be chosen to render the sole substantially waterproof while still maintaining the fibrous character of the sole so that ice and snow collects at the bottom of the sole. Rather than constructing the sole 102 from a first part 105 of a singular layer, the first sole part can be composed of a number of thin foamed-filled layers. The fibers of such layers can be unidirectional so that the fibers of the layers may be placed in different directions to form a lamination somewhat analogous to the laminations of a sheet of plywood.

The insole 102 (FIG. 14) is composed of a layer or multiple layers of substantially liquid-impermeable materials, e.g., closed-cell foam shock absorption and/or thermal insulation materials. For example, Ensolite® materials obtainable from Uniroyal Plastics Company can be used. When multiple layers of these materials are used, the layer closest to the sole should be a thicker layer of more dense foam than the layer(s) above it. A thicker, denser layer on the bottom provides support for the foot of the wearer, as well as, protection from rough ground surface conditions. Further, the closed-cell foam materials limits moisture, which is present in the nonwaterproof sole material, from reaching the foot of the wearer.

Figure 14:
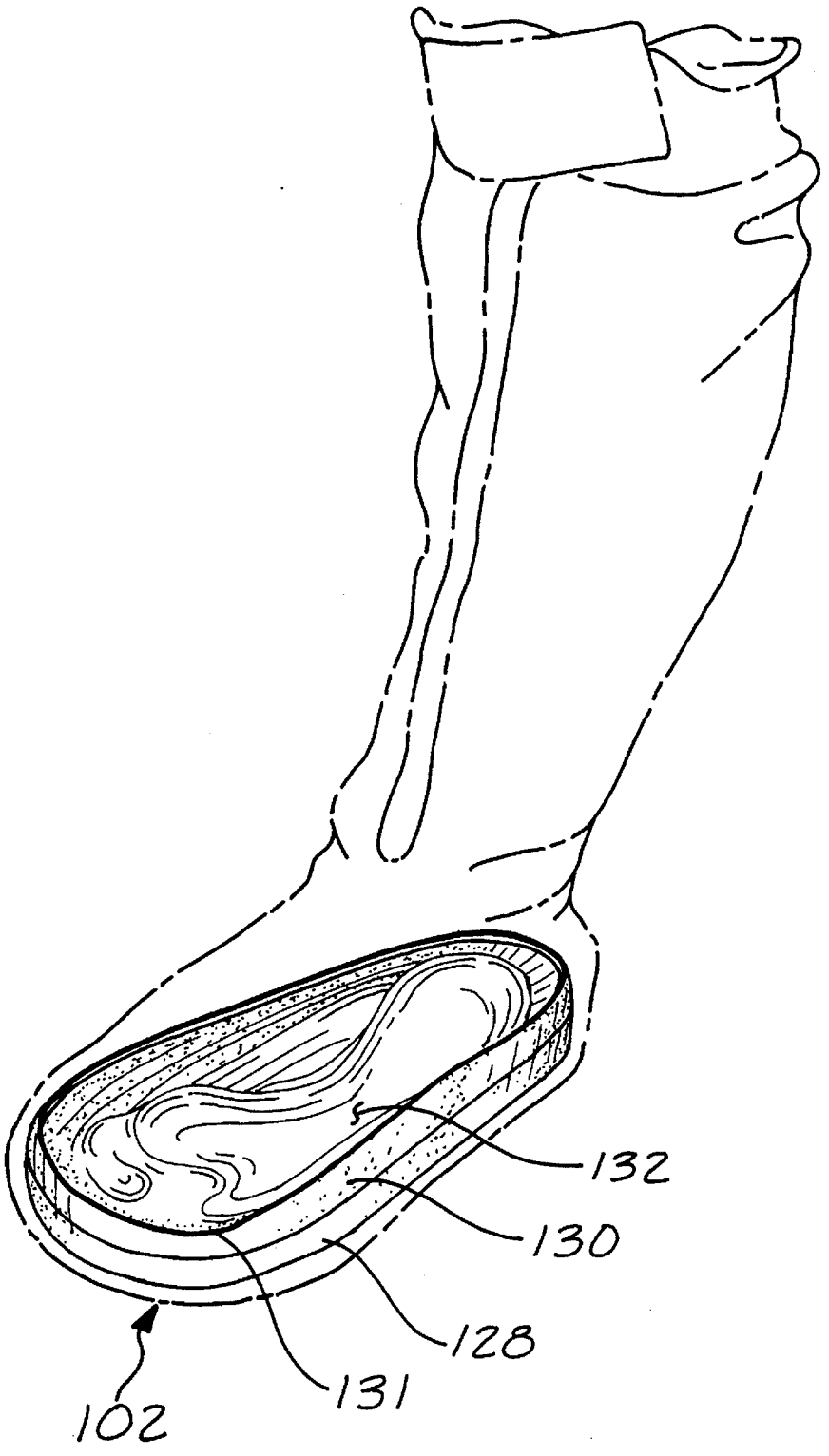
FIG. 14 shows another embodiment of an insole in solid line, with an outer sole and upper shown in phantom line.

Preferably, as shown in FIG. 14, two layers 128, 130 of closed-cell foam materials are used, the bottom layer 128 being from about 1/2 to 5/8 inch thick and more dense than the top layer 130 which preferably is about 1/4 to 3/8 inch thick. The insole can further include a layer 131 above the foam layers comprising a thin, soft pressed felt or other soft material, preferably less than 1/4 inch thick. Alternatively, especially if the footwear article is worn as a complete boot over a sock or bare foot, a thin-formed insert layer (for instance, formed from cork or other suitable material)can be used on top of the foam layers 128 and 130. The insert layer provides support for the foot of the wearer. Birkenstock® brand inserts are an example of useful support materials.

In addition or in lieu of the uppermost layer 131, an orthopedic insert (not shown) may be utilized. The orthopedic insert may be of the "off-the-shelf" variety or it may be specifically prescribed for and custom fit to the wearer. Through the use of the orthopedic insert together with the ability of the foot to naturally spread out during foot plant, foot problems of the wearer may be corrected or at least reduced.

The various layers of the insole 102 may be bonded together on top of each other with an adhesive. Further, inserts of dense foam, gel or other material of requisite structural integrity can be placed in between layers of the insole to provide support for the arch or raising of the heel. Also, wear resistant material may be placed at the ball and heel areas for reinforcement of the insole. The combination of bonded insole layers can be attached to the other parts of the footwear article, however, it is preferred to have it merely placed inside the sole.

The insole layers are formed such that there is created an indentation 132 for the foot of the wearer which is generally the same shape and size as the foot. The indentation 132 can be formed by securing a hollow plastic tubing 65 (FIG. 10) between two layers of the insole 122 such that the tubing extends in a continuous fashion between the layers of insole roughly in the shape of the outline of the foot of the wearer, except larger. Alternatively, as discussed more fully below in conjunction with FIG. 17 and 19, the indentation 132 can be created through the use of a foam riser of bevel or triangular cross-section extending along the perimeter of the insole 103 between the two insole layers 128 and 130.

The insole 102, as a whole, extends outward somewhat from the indentation 132 such that the surface area of the bottom fiat suffice of the insole 102 is larger than the surface area of the indentation 132 of the insole 102 corresponding to the foot of the wearer. The oversize of the insole 102 on the sides, heel, and toe relative to the indentation 132 for the foot of the wearer enhances the traction properties of the footwear. The insole 102 provides a structure around the bottom, sides, heel, and toe of which the sole 101 is positioned. Thus, the area of the sole 101 which contacts the ground surface is correspondingly oversized with the bottom of the insole 102. The sole 101 is also drawn in a rounded fashion around the side edges of the insole to extend up the sides of the article from where it contacts the ground surface. The overall impression of the oversized sole-insole combination is that of a padded paw, like an animal's paw. This combination provides a large surface area of contact between the sole 101 and the ground surface. Increased surface area of contact relates directly to higher traction.

Figure 15:
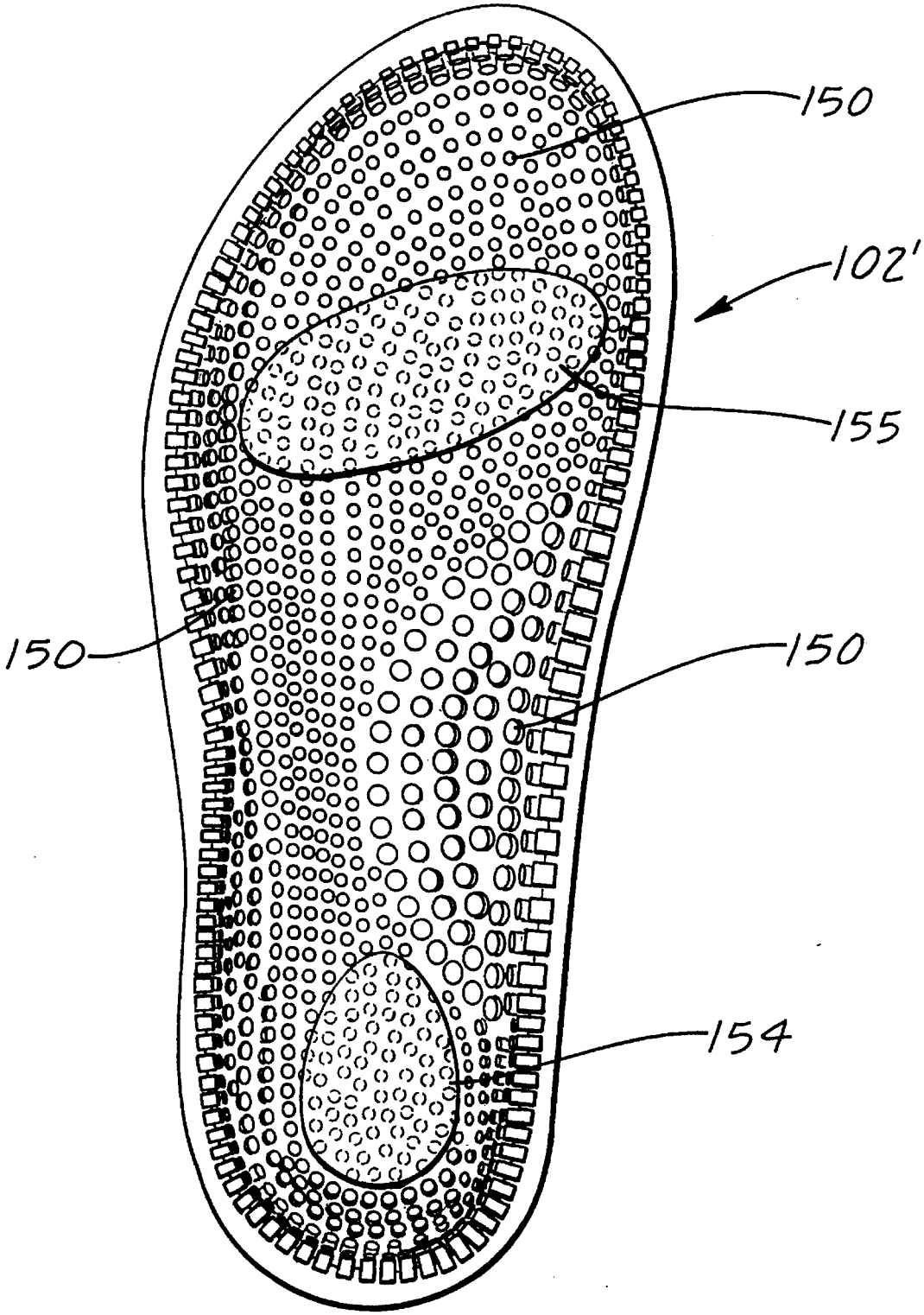
FIG. 15 is a top view of an insole having knobs for stimulating pressure points in the foot and creating a path for air to move beneath and to the sides of the foot.

FIG. 15 shows an alternative embodiment of an insole 102' in which the foot contact surface is provided with an arrangement of upwardly and sideways extending knob-like projections 150 made of a variety of possible materials, including, flexible natural and/or synthetic rubber, various types of foams, compressed fibers or a combination thereof Ideally, such compressed fibers would be selected to produce a wicking action to draw moisture away from the foot. Examples of such suitable materials include, without limitation, felts, polypropylene, Capilene™ and Polartech™. The knob-like projections 150 have varying heights and have "heads" of various sizes (diameters) to conform to the foot of the wearer and to perform the desired functions. The projections 150 stimulate nerves in the foot, provide orthopedically optimal foot support, reduce fatigue, and allow body moisture to evaporate, thereby improving the thermal characteristics of the footwear article. Also, by supporting the foot above and laterally of the insole, the projections create a thermal insulating layer below and to the sides of the foot. The insole 102' may include a heel insert 154 made of a dense closed cell foam, a viscous gel encapsulated within an envelope, or other suitable material for supporting the heel of the wearer. A similar insert 155 is provided for extra support at the ball of the foot of the wearer. Similar supports may be provided at other high pressure locations of the foot. Preferably, the inserts 154 and 155 are also supported above the insole by projections 150 so that the thermal insulating layer does extend beneath the inserts.

In cases in which the footwear article is not provided with an insole, the side of the sole that contacts the foot of the wearer is made waterproof. Waterproofing of the inner contact surface may be done in any manner, for example, by chemical impregnation, spraying, or coating. The inner contact surface may, of course, be made waterproof for a footwear article having an insole, but this may not be necessary since the insole does prevent substantially all or most of the moisture from reaching the foot of the wearer.

One possible fastening system for the boot 100 will be described with reference to FIGS. 12–13. A length of fabric 152 is attached along the upper margin of the upper intermediate member 108 on the outside surface and folded over and attached along the upper margin of the inside surface of the upper intermediate member 108 to form an interior channel or seam around the upper perimeter of the upper intermediate member 108. The lower perimeter of the upper 104 is attached along the fabric 152. The channel is open at two ends, located adjacent one another at the rear ankle portion of the footwear article. A drawstring 118 runs through the length of the channel, with each end of the drawstring projecting through the opening and engaging a barrel clip 120. The drawstring 118 may be adjusted to tighten or loosen the boot 100 on the wearer.

Retaining members 124, e.g., fabric or rubber loops, are attached at the interface between the intermediate members 106, 108. Retaining members 124, preferably made of the same material as the lower intermediate member 106, are provided at the sides of the ankle portions of the boot 100. Also, two retaining members 124, preferably made of nylon, are provided at the heel portion of the boot 100. One upper edge of each retaining member 124 at the heel portion of the boot 100 is attached to the fabric 152 forming the channel and the bottom edge is attached to the upper intermediate member 108. An anchoring member 140, e.g., a D-ring, is attached at the inside ankle portion of the boot 100 by the retaining member 124 located in that area. A nylon strap 114 having one end fastened to the anchoring member 140 extends rearwardly along the sole 101 to thread through the two retaining members 124 at the rear ankle portion of the boot 100 and then forwardly along the opposite side of the sole and through the retaining member 124. The strap then extends across the sole 101 through the anchoring member 140 and then the free end of the strap is crossed-back on itself. The strap 114 is provided with Velcro® hooks and loops fastener 142 for fastening the strap 114 over on itself at the front ankle portion of the boot 100.

A fastening strap 116 may also be provided near the front toe portion of the boot. The strap 116 has one end attached to the interface between the lower and upper intermediate members 106, 108. An anchoring member 144, e.g., a D-ring, is attached by way of a retaining member 124 to the opposite side of the boot. The strap 116 extends across the toe portion of the sole 101 and is threaded through the anchoring member 144 and then the free end of the straps is crossed-back on itself. The strap 116 may be adjusted to tighten or loosen the boot 100 on the foot, and fastened to itself with a Velcro® hooks and loops fastener 146 provided on the strap 116.

In certain situations, such as for children's footwear, only a singular strap 114 or 116 may be needed. Alternatively, the singular strap may be positioned at a different location from the locations of straps 114 and 116.

Figure 17:
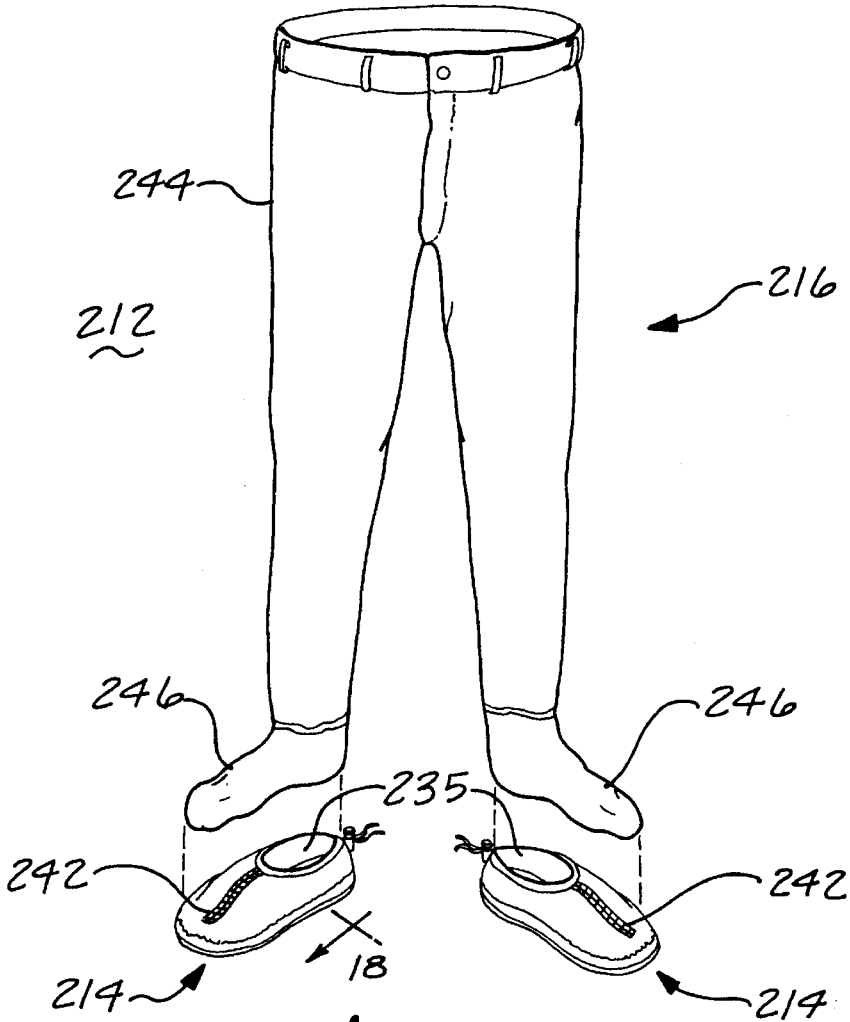
FIG. 17 is a cross-sectional view of FIG. 16 taken along line 17—17 thereof.
Figure 18:
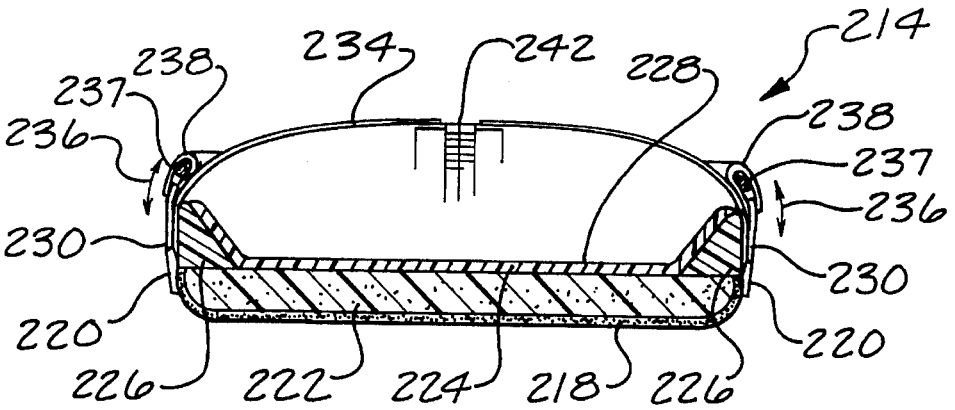
FIG. 18 is a perspective view of an additional preferred embodiment of the footwear article in accordance with the present invention.

A further embodiment 212 of the present invention is shown in FIGS. 17 and 18. This particular embodiment includes a shell base 214 and a removable upper 216. It will be appreciated that the embodiment of the present invention shown in FIGS. 17 and 18 is somewhat similar to that shown in FIGS. 12–14, however, with the upper 216 being detachable from the shell 214 base rather than integrally constructed together in the manner of the upper 104 and the sole 101 of the boot 100 shown in FIGS. 12–14. Moreover, as described more fully below, the manner in which the shell base 214 is held on the wearer's foot also is different than illustrated in FIGS. 12 and 13 and described above.

The shell base 214 includes an outsole portion composed of a bottom part 218 corresponding to the bottom part 105 of the sole 101 shown in FIGS. 12–14. The outsole also includes a side part 220 extending upwardly from the sole bottom part around the perimeter of the sole bottom part. Preferably the composition of the outsole bottom and side parts 218 and 220 may be similar to or the same as the comparable components 105 and 107 shown in FIGS. 12 and 13.

The shell base 214 also includes an insole composed of multiple layers of substantially liquid-impermeable closed cell foam. In this regard, the insole preferably includes a base 222 of a closed cell foam material (from about ⅜ to ⅝ of an inch thick) and an upper thinner layer 224 (from about ¼ to ⅜ of an inch thick) of lesser dense closed cell foam material. The insole also includes an abutment 226 that is triangular or bevel-shaped in cross section extending around the perimeter of the insole base layer 224 to form a fitted foot bed 228. Preferably, the side part 220 of the outsole extends upwardly along at least part of the elevation of outer surface of the insole abutment 226, FIG. 18. The components of the insole may be attached together and to the components of the outsole by any of the aforementioned methods, including by sewing or bonding or both.

The shell base 214 also includes an intermediate member 230 having its lower edge extending upwardly from the outsole side part 220 and over the exterior of the insole abutment member. The intermediate member 230 extends only slightly beyond the top of the abutment member 226 so as to provide an attachment margin for the elastic top member 234 of the shell base 214. As shown in FIGS. 17 and 18, the lower margin of the top member 234 is attached to the upper margin of the intermediate member 230. The top member forms the counter and vamp of the shell base 214 and preferably is sized to snugly receive the foot of the wearer through an opening 235.

Preferably, the intermediate member is composed of a unidirectional elastic belting material that provides for stretching in the direction of arrows 236, i.e., in the generally upward direction, but not in a direction normal to the arrows 236, e.g., longitudinally along the length of the shell base. Also, ideally, the top member 234 is composed of an elastic mesh material that stretches in all directions. Such materials are common articles of commerce, one example being material sold by Darlington Mills of New York, N.Y. under the designation Leno™.

Ideally, the top member 234 is taut enough to securely hold the shell base 214 on the wearer's foot. If need be, a drawstring 237 may be utilized to further secure the shell base 214 on the wearer's foot. The drawstring 237 may be similar to drawstring 118 shown in FIGS. 12 and 13. In this regard, the drawstring 237 extends through an interior channel 238 formed by a length of fabric having its longitudinal side margins folded over underneath itself and then sewn to the exterior of shell base 214 along the seam between the intermediate member 230 and the top member 234. A slit can be provided in the channel 238, for instance at the back of the heel, through which the free ends of the drawstring 237 may exit the channel. As in the embodiment of the present invention shown in FIGS. 12–14, a barrel clip, not shown, can be provided to engage the ends of the drawstring 237 to maintain the drawstring in the desired tightened or loosened condition.

Also, to augment the top member 234, a strap, for instance, similar to strap 114 shown in FIGS. 12 and 13, can be used. Such strap (not shown in FIGS. 17 and 18) may be useful to hold the wearer's heel against the heel portion of the shell base 214, especially during strenuous or vigorous activities, such as running or rock climbing.

Although not illustrated in FIGS. 17 and 18, a layer of washable, breathable warm material, such as fleece, can be used to overlie the top member 234. Such fleece layer could be used not only to enhance the appearance of the shell base, but also provide protection and warmth for the wearer. Whether or not a layer of material is used to overlie the top member, a slide fastener 242 can be incorporated into the top member in the direction forwardly from the foot opening 235. As will be appreciated, the slide fastener 242 could make it more convenient for donning and duffing the shell base 214.

The upper 216 is composed of a garment in the form of trousers 244 and integral sock portions 246. The garment 216 can be composed of a washable, breathable warm material, such as fleece for general all-around wear. However, the garment 216 can be designed for special purposes. For instance, for fishermen, kayakers and other in-water situations the garment can be composed of wet suit material.

It is to be understood that the upper 216 shown in FIG. 17 may be replaced with other types of garments, such as bibs having integral sock portions or a full body garment, for instance, of the nature worn by parachuters. In addition, the upper 216 may be composed simply of sock portions 246 and integral leg portions of any height from as low as the ankle to as high as the thigh. As with the upper 104 discussed above, such integral sock and leg portions can be held in place by numerous convenient methods.

It will be appreciated that the shell base 214 shown in FIGS. 17 and 18 is composed of fewer components than the corresponding portion of the boot 100 shown in FIGS. 12–14, especially in the manner in which the shell base is retained on the wearer's foot. In this regard, the top member 234 of the shell base 214 replaces the numerous components of the straps 114 and 116 of the boot 100 shown in FIG. 13. Nonetheless, there may be situations in which retaining straps, such as straps 114 and 116 shown in FIG. 13, are also desirable.

Figure 19:
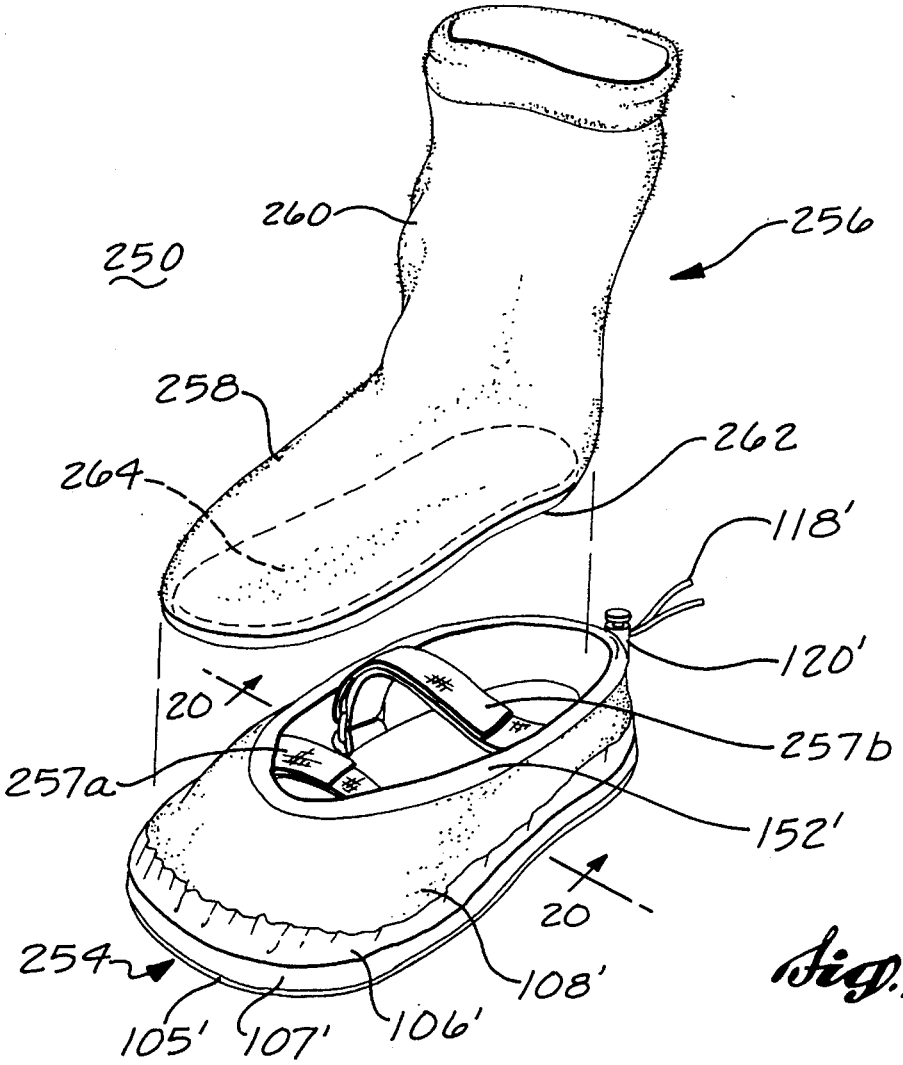
FIG. 19 is a cross-sectional view of FIG. 18 taken along line 19—19 of FIG. 18, showing the interior construction of the footwear article.
Figure 20:
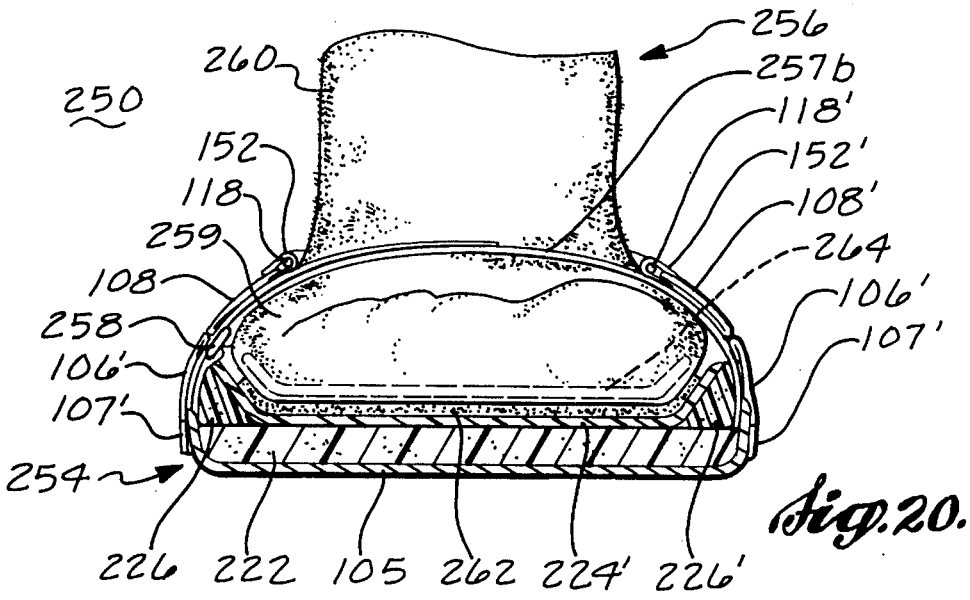
FIG. 20 is a bottom view of an outer sole having plural, edgewise ground contact layers.

FIGS. 19 and 20 illustrate a further preferred embodiment of the present invention also involving a two-piece footwear unit 250 composed of shell base 254 and a removable upper 256. The shell base 254 in significant respects is constructed similarly to the sole 101 shown in FIGS. 12 and 13. Accordingly, rather than needlessly repeating such construction, like components are given the same item number as shown in FIGS. 12 and 13, but with the addition of the prime "'" designation. The shell base 254 employs an insole similar to the insole shown in FIG. 18. Likewise, rather than repeating the detailed description of such construction, like components are given the same item number as shown in FIG. 18, but with the addition of the prime "'" designation.

The shell base 254 utilizes a strap system similar to that shown in FIGS. 12 and 13 for retaining the shell base on the wearer's foot in that two cross straps **257*a* and 257*b* are used. One end of each strap is anchored to the interior of the lower intermediate member 106' at one side of the shell base 254. The straps engage through anchoring members, e.g., D-rings 258, anchored to the inside of the lower, intermediate member 106' at the opposite side of the shell base 254. The straps 257*a* and 257*b* are folded back over on themselves and are held in place by Velcro® hooks and loops fasteners in the same manner as straps 114 and 116 discussed above relatives to FIGS. 12 and 13**.

As shown in FIGS. 19 and 20, the upper 256 includes a sock portion 259 to receive the foot of the wearer and an integral leg portion 260 extending upwardly along the calve of the wearer. An elastic band, not shown, or other system may be integrated into the construction of the leg portion 260 to maintain it in place on the leg. The upper 256 also includes a thin bottom layer 262 of relatively soft resilient material attached to the underside of the sole portion 258 to provide traction so that the upper may be worn without the shell base, for instance indoors, or even outdoors on a limited basis. Preferably, the bottom layer 262 is composed of a felt or other material of the nature employed to form the sole part 105 discussed above. Alternatively, especially if the upper is worn on an indoor slick surface, the bottom layer 262 may be composed of natural or synthetic rubber or a combination thereof.

To provide additional comfort and support to the wearer, a formed foam insole 264 is utilized inside of the sock portion 258. The insole 264 may be composed of a singular member or of several components, for instance in the nature of the insole shown in FIG. 14 or the insole shown in FIGS. 17–18. In lieu of the insole 264, an orthopedic insert (not shown) may be utilized. As noted above with respect to insole 102, the orthopedic insert may be of the "off-the-shelf" variety or may be specifically prescribed for and custom fit to the wearer.

Although the upper 256 is illustrated as being of calf length, it will be appreciated that the upper can be of any desired height all the way from the ankle to the thigh. Moreover, the upper can be integrated into an item of clothing, such as pants, a bib or a full body suit. It will also be appreciated that the wearer may utilize several different types of uppers in conjunction with a singular shell base 254. Further, through the foregoing construction, the upper may be worn primarily indoors, with the shell base being donned when outdoors. This could help in maintaining a cleaner indoor environment and also in preventing the moisture that may have accumulated within the outsole of the shell base from being undesirably "tracked in" to the indoors, especially into living quarters.

Figure 16:
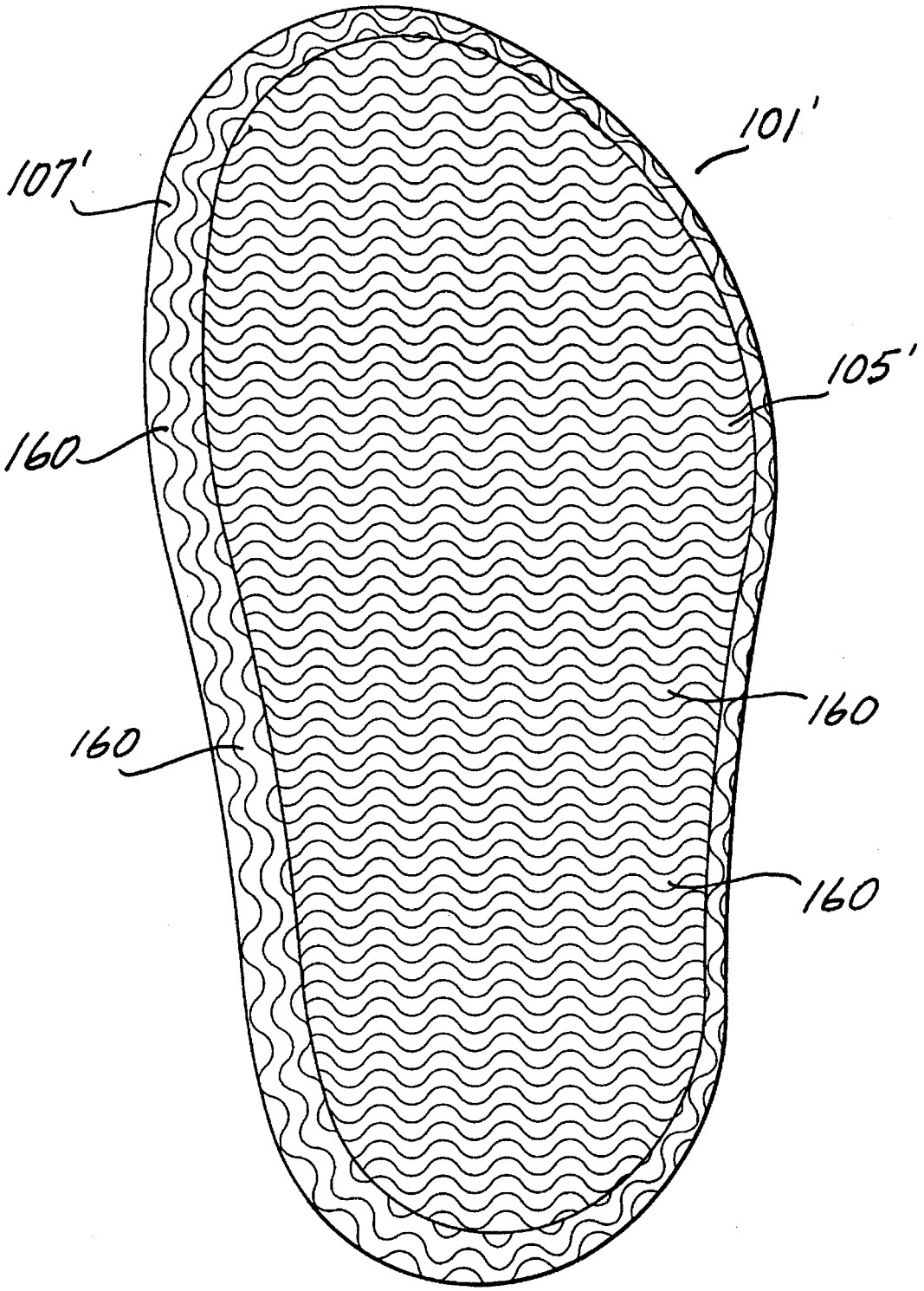
FIG. 16 is a perspective view of a further preferred embodiment of the footwear article in accordance with the present invention.
Figure 21:
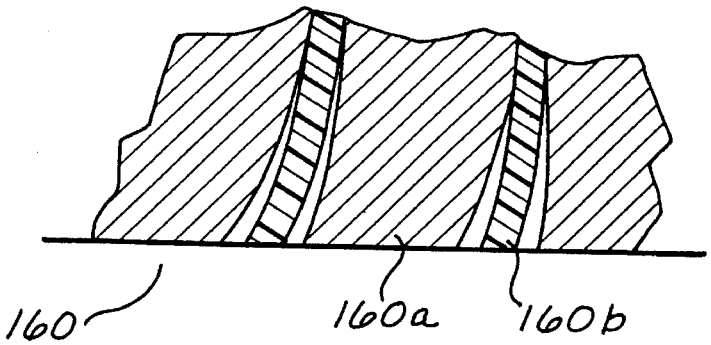
FIG. 21 is a partial view of the sole shown in FIG. 20, showing spreading of adjacent edgewise layers when the sole contacts the ground.

FIGS. 16 and 21 show an alternative embodiment of a sole 101' in which the sole has an edgewise layered configuration. The layers 160 all may be made of a fibrous material that is pliable and breathable, e.g., felt. Alternatively, some of the layers **160*a* may be made of a fibrous material that is pliable and breathable and some of the layers 160*b*** may be made of an elastomeric material, e.g., rubber. For example, layers of felt and rubber may be arranged in alternating fashion.

On the first interior sole part 105', the layers 160 are disposed edgewise to the bottom of the sole 101' to run across the width of the footwear article. On the second exterior or perimeter sole part 107, the layers 160 are disposed edgewise to the bottom of the sole 101' to run in the lengthwise direction. In the illustrated embodiment, the layers 160 have a wavy configuration; however, the layers 160 may be configured in other manners, e.g., they may be straight.

In the case in which all of the layers 160 are made of a fibrous material that is pliable and breathable, the layers 160 may be formed simply by making cuts in the sole material. In the case in which some layers **160*a* are made of fabric and other layers 160*b* are made of an elastomeric material, the layers must be secured to a horizontal sole base (not shown), e.g., by lamination, such that the layers 160 extend substantially downwardly from the base. The sole base can be composed of a rubber material or other types of material that could be securely bonded to the upper edges of the layers 160. Also, if the sole base were composed of a rubber material, a barrier would be formed against moisture tending to wick up the fibrous material. As shown in FIG. 21, the lower portions of adjacent layers 160 are freely separable such that during walking, adjacent layers separate and spread, resulting in improved traction. Extending the layer 160** across the sole enhances traction in the fore and aft directions.

The layers 160 on the sole side part 107' run lengthwise with respect to the footwear article, because these parts of the sole typically contact the ground or other objects as a result of unevenness of the ground or sideways movement of the foot. Thus, the lengthwise extending layers 160 will provide traction in the lateral or sideways direction.

Figure 22:
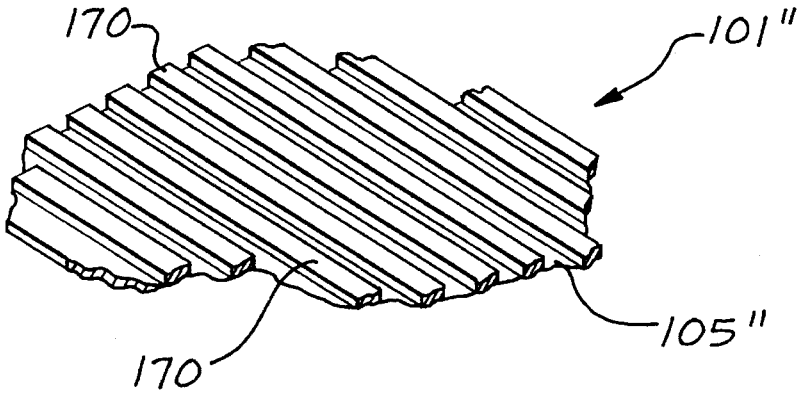
FIG. 22 partial perspective view of a sole ground contact surface having ridges for improved traction.
Figure 23:
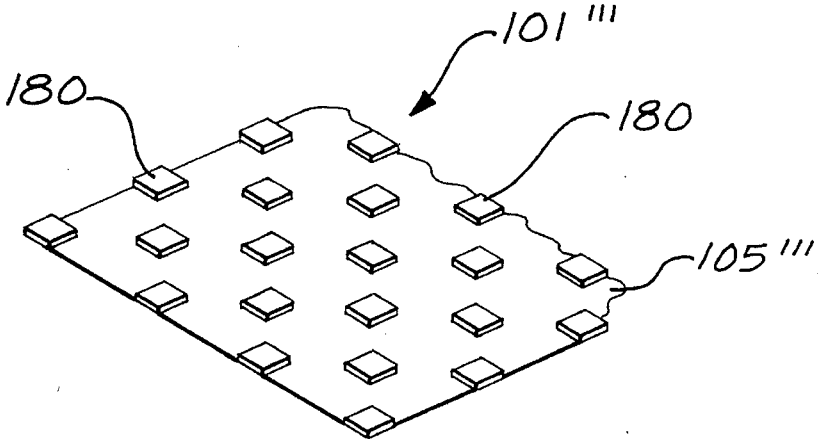
FIG. 23 is a partial perspective view of a sole ground contact surface having pads for improved traction; and, FIG. 24 is a cross-sectional view of a further alternative embodiment of the present invention.

The bottom of the sole bottom part 105 may be configured in a variety of ways. For example, FIGS. 22 and 23 show further embodiments of a sole for a footwear article in accordance with the present invention. More specifically, FIG. 22 shows a sole 101" made of a fibrous material that is pliable and breathable, in which the sole 100" is provided with ridges 170 for improved traction in certain conditions. The ridges 170 may be formed in numerous ways, e.g., by compression.

FIG. 23 shows a sole 101''' composed of a bottom part 105''' having a base with a nominally substantially planar or at least generally planar ground contact surface and pads 180 arranged in alternating fashion and attached to the ground contact surface such that parts of the ground contact surface are covered by the pads 180 and other parts are not. The pads 180 are made of a tough fibrous material that is pliable and breathable, e.g., felt. Although in the illustrated embodiment, the pads are rectangular, the pads may be any shape, e.g., circular or oval. This embodiment has the advantage of improved traction in the fore and aft directions and in the lateral or sideways direction.

Figure 24:
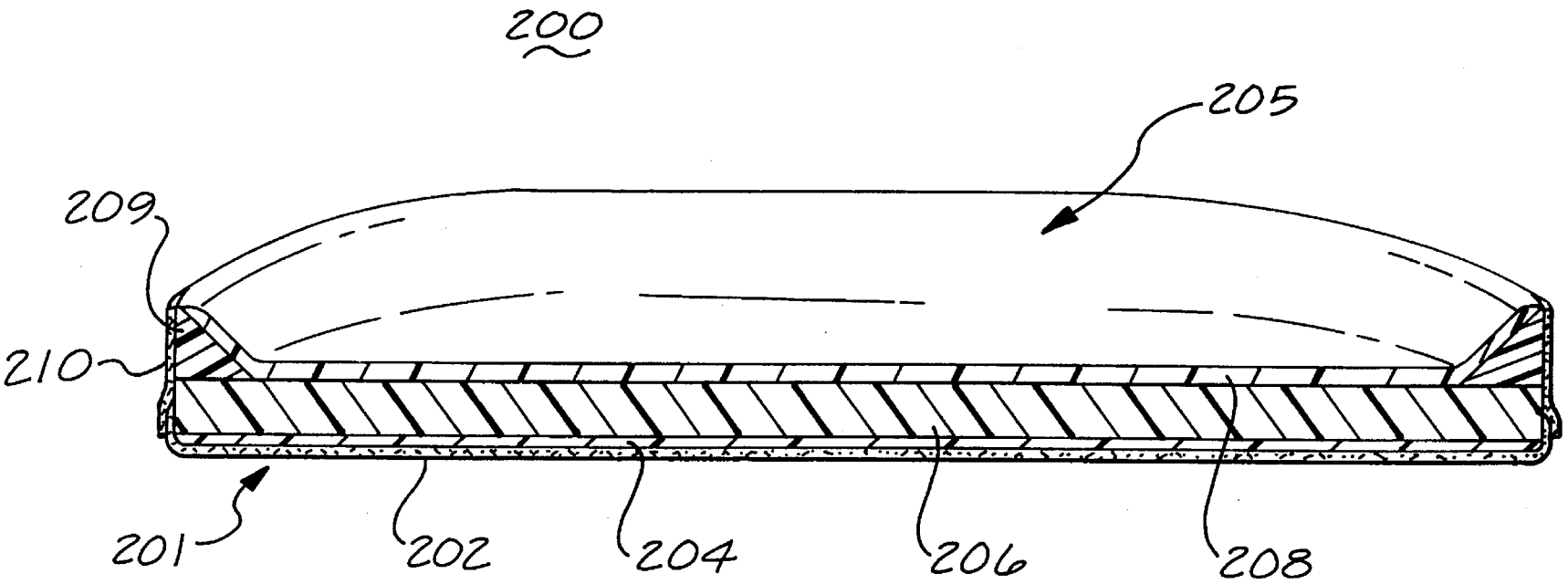

FIG. 24 illustrates a further embodiment to the present invention incorporating an integral sole/footbed 200 composed of an outsole 201 with bottom layer 202 of fibrous, porous, breathable material and an upper layer 204 of flexible rubber or synthetic rubber material. The insole portion 205 of the integral sole/footbed 200 includes a lower layer 206 of relatively dense closed-cell sole foam material and an upper layer 208 of relatively less dense closed-cell foam material. An abutment ridge 209 extends around the perimeter of the insole 205 between the margins of the lower layer 206 and the upper layer 208. The insole 205 composed of layers 206 and 208 could be constructed substantially the same as the insole 103 illustrated in FIG. 14 and discussed above. The various layers of the integral sole/footbed 200 may be laminated upon together, for instance, by gluing, thereby eliminating the need for sewing. The rubber layer 204 of the outsole 201 adds durability to the outsole and also forms a barrier against the moisture that may wick up through the bottom layer 202 of the outsole, thereby preventing the moisture from reaching the insole layers 206 and 208.

As also shown in FIG. 24, a vertical layer 210 of fibrous, porous, breathable material may be extended around the perimeter of the integral sole/footbed 200. The inner surface of the vertical layer 210, at least the portion corresponding to the elevations of the rubber layer 200 and insole layers 206 and 208 may be rendered waterproof, by methods discussed above, to prevent moisture wicking up the vertical layer to reach the insole layers 206 and 208.

While the preferred embodiments of the present invention have been illustrated and described, it will be appreciated that various changes can be made therein without departing from the spirit and scope of the invention.

The embodiments of the invention in which an exclusive property or privilege is claimed are defined as follows:

1. A footwear article for use to be worn on a foot of a user, comprising:

a lower portion comprising (a) a first sole part made of a fibrous material that is pliable, the fibrous first sole part having a generally planar ground contact surface, and (b) a second sole part made of a fibrous material that is pliable, the fibrous second sole part having an upper edge and a lower edge defining a height, the lower edge of the fibrous second sole part being attached near the periphery of the fibrous first sole part such that the fibrous second sole part extends upwardly from the fibrous first sole part to form a cavity; and, an insole having (a) sides (b) a foot contact receiving surface, (c) an abutment ridge extending around the outer perimeter of the foot contact receiving surface, including along the sides of the insole, the abutment ridge having a base portion and having a height projecting upwardly to an elevation above the foot contact surface sufficient to serve as an abutment to contain the user's foot, and (d) a generally planar lower contact surface extending below the foot contact receiving surface as well as beneath the base of the abutment ridge;

the insole comprising at least one layer of material that is at least partially liquid-impermeable; and the insole being inserted in the cavity formed by the fibrous first and second sole parts such that the inner side of the fibrous first sole part substantially covers the lower contact surface of the insole and the fibrous second sole part is oriented substantially parallel to the sides of the insole.

2. The footwear article of claim 1, further comprising an upper portion made of a pliable, breathable material, and extending upwardly from the lower portion.

3. The footware article of claim 2:

wherein the upper portion extending upwardly from the sole, the upper portion having a recess formed therein, the recess extending around the ankle and toe areas of the footwear article, and a part of the upper portion extending outside of the recess; and further comprising a fastening system, comprising:

at least one retaining member attached on the inside of the recess near the ankle area of the footwear article;

an anchoring member attached on the inside of the recess near the ankle area of the footwear article;

a first strap slidably retained in the retaining member near the ankle area of the footwear article, the first strap encircling the ankle area of the recess and over the part of the upper extending outside of the recess, and the ends of the first strap engaging the anchoring member near the ankle area of the footwear article such that the first strap may be adjusted;

at least one retaining member attached on the inside of the recess near the toe area of the footwear article;

an anchoring member attached on the inside of the recess near the toe area of the footwear article; and a second strap slidably retained in the retaining member near the toe area of the footwear article, the second strap encircling the toe area of the recess and over the part of the upper extending outside of the recess, and the ends of the second strap engaging the anchoring member near the toe area of the footwear article such that the second strap may be adjusted.

4. The fastening system of claim 3, wherein the anchoring member near the ankle area and the anchoring member near the toe area are D-rings.

5. The fastening system of claim 3, wherein the first and second straps are provided with hooks and loops fasteners for securing the first and second straps, respectively.

6. The fastening system of claim 3, further comprising an adjustable drawstring adapted to engage the footwear article around the border of the recess.

7. The footwear article of claim 2, wherein the upper portion is detachably engaged to the lower portion.

8. The footwear article of claim 7, wherein the upper portion is detachably engaged to the lower portion by a stretchable, resilient top extending over the insole.

9. The footwear article of claim 7, wherein the upper portion is detachably engaged to the lower portion by a plurality of cross straps extending across and above the insole.

10. The footwear article of claim 1, wherein the first sole part and the second sole part are unitary.

11. The footwear article of claim 1, wherein the first sole part and the second sole part are separate pieces, and the first sole part is sewn to the second sole part.

12. The footwear article of claim 1, wherein the first sole part and the second sole part are separate pieces, and the first sole part is bonded to the second sole part.

13. The footwear article of claim 2, wherein the fibrous material of the sole second part is impregnated with foam selected from the group consisting of rubber, synthetic rubber, styrene, polyethylene, copolymers, neoprene, hypalon, polypropylene and Styrofoam.

14. The footwear article of claim 1, wherein the first sole part is made of felt.

15. The footwear article of claim 1, wherein the second sole part is made of felt.

16. The footwear article of claim 1, wherein the fibrous material of the sole first part is impregnated with foam selected from the group consisting of rubber, synthetic rubber, styrene, polyethylene, copolymers, neoprene, hypalon, polypropylene, Styrofoam and nitrite.

17. The footwear article of claim 1, wherein the generally liquid-impervious material of the insole is composed of closed-cell foam.

18. The footware article of claim 1, wherein the first sole part of the lower portion, comprising:

a base having a substantially planar outer contact surface; and a plurality of ground contact layers extending over substantially the entire outer contact surface of the base and extending substantially edgewise to the base, each layer having an upper portion and a lower portion, the upper portion of each layer attached to the base such that the layer extends substantially downwardly from the outer contact surface and the lower portion of each layer is separable from the lower portion of an adjacent layer, wherein the layers are made of a fibrous material that is pliable and breathable.

19. The sole of claim 18, wherein the layers are made of felt.

20. The sole of claim 18, wherein at least some of the layers of the ground contact layers are composed of elastomeric material.

21. The sole of claim 20, wherein the elastomeric material is rubber.

22. The footware article of claim 1, further comprising a plurality of fabric pads arranged in spaced relation on the ground contact surface of the first sole part and attached thereto such that parts of the ground contact surface are covered by fabric pads and parts of the ground contact surface are not covered by fabric pads.

23. The sole of claim 22, wherein the fabric is felt.

24. The sole of claim 22, wherein the pads are from about 1/16 to about 1/8 inch thick.

25. A footwear article for use to be worn on a foot of a user, comprising:

a lower portion comprising (a) a first sole part made of a fibrous material that is pliable, the fibrous first sole part having a generally planar ground contact surface, and (b)a second sole part made of a fibrous material that is pliable, the fibrous second sole part having an upper edge and a lower edge defining a height, the lower edge of the fibrous second sole part being attached near the periphery of the fibrous first sole part such that the fibrous second sole part extends upwardly from the fibrous first sole part to form a cavity an intermediate portion having an upper edge and a lower edge defining a height, the intermediate portion comprising a first intermediate member made of a water-resistant material and having an upper edge and a lower edge defining a height, the intermediate portion being attached near its lower edge to the fibrous second sole part near its upper edge;

an upper portion made of a pliable, breathable material, the upper portion covering at least part of the top of the foot of the user when the footwear article is worn; and, an insole having (a) sides, (b) a foot contact surface, (c) an abutment ridge extending around the outer perimeter of the insole outwardly of the foot contact surface thereby also extending along the sides of the insole, the abutment ridge having a base portion extending along the outer perimeter of the foot contact surface and having a height projecting upwardly to an elevation above the foot contact surface sufficient to contain the user's foot within the confines of the foot contact surface, and (d) a generally planar lower contact surface extending below the foot contact surface as well as below the base of the abutment ridge, and the insole being inserted in the cavity formed by the fibrous first and second sole parts such that the inner side of the fibrous first sole part substantially covers the lower contact surface of the insole and the fibrous second sole part as oriented substantially parallel to the sides of the insole.

26. The footwear article of claim 25, wherein the intermediate portion further comprises at least a second intermediate member having an upper edge and a lower edge defining a height and being made of an elastic, breathable material, and wherein the first intermediate member is attached near its lower edge to the second sole part near its upper edge and the second intermediate member is attached near its lower edge to the first intermediate member near its upper edge.

27. The footwear article of claim 25, wherein the first intermediate member is waterproof.

28. The footwear article of claim 27, wherein the first intermediate member is made of rubber.

29. The footwear article of claim 25, further comprising retaining means for disengageably receiving the upper portion within the cavity of the base portion.

30. The footwear article of claim 29, wherein the retaining means comprise a stretchable, resilient top extending over the cavity of the base portion and attached to the base portion.

31. The footware article of claim 29, wherein the retaining means comprise a plurality of straps extending across the cavity of the base portion.

32. A footwear article for use to be worn on a foot of a user, comprising:

a lower portion comprising (a) a first sole part made of a fibrous material that is pliable, the fibrous first sole part having a generally planar ground contact surface, and (b) a second sole part made of a fibrous material that is pliable, the fibrous second sole part having an upper edge and a lower edge defining a height, the lower edge of the fibrous second sole part being attached near the periphery of the fibrous first sole part such that the fibrous second sole part extends upwardly from the fibrous first sole part to form a cavity, an intermediate portion having an upper edge and a lower edge defining a height, the intermediate portion comprising at least one intermediate member made of an elastic, breathable material and having an upper edge and a lower edge defining a height, the intermediate portion being attached near its lower edge to the fibrous second sole part near its upper edge;

an upper portion adapted to be received within the cavity of the lower portion, the upper portion being made of a pliable, breathable material; and an insole:

having (a) sides, (b) a foot contact area (c) an abutment ridge extending around the outer perimeter of the insole outwardly of the foot contact area thereby including extending along the sides of the insole, the abutment ridge having a base portion extending outwardly from the foot contact area and projecting upwardly to a height above the foot contact area to contain the user's foot within the confines of the foot contact area, and (d) a generally planar lower contact surface extending below the entire insole, including beneath the foot contact area as well as beneath the base of the abutment ridge; and, the insole being inserted into the cavity formed by the fibrous first and second sole parts such that the inner side of the fibrous first sole part substantially covers the lower contact surface of the insole and the fibrous second sole part is oriented substantially parallel to the sides of the insole.

33. An overshoe for use to be worn over a shoe of a user, comprising:

a lower portion comprising (a) a first sole part made of fibrous material that is pliable, the fibrous first sole part having a generally planar ground contact surface, and (b) a second sole part made of a fibrous material that is pliable, the fibrous second sole part having an upper edge and a lower edge defining a height, the lower edge of the fibrous second sole part being attached near the periphery of the fibrous first sole part such that the fibrous second sole part extends upwardly from the fibrous first sole part to form a cavity; and;

an insole:

having (a) sides, (b) a foot contact area, (c) an abutment ridge extending around the outer perimeter of the insole outward of the foot contact area thereby including extending along the sides of the insole, the abutment ridge having a base portion disposed outwardly of the foot contact area and an upwardly projecting portion extending upwardly to an elevation above the foot contact area to contain the user's foot within the confines of the foot contact area, and (d) a generally planar lower contact surface extending beneath the entire insole, including below the foot contact area as well as below the base of the abutment ridge;

the insole comprising at least one layer of material that is at least partially liquid-impermeable, the insole being inserted in the cavity formed by the fibrous first and second sole parts such that the inner side of the fibrous first sole part substantially covers the lower contact surface of the insole and the fibrous second sole part is oriented substantially parallel to the sides of the insole.

* * * * *

UNITED STATES PATENT AND TRADEMARK OFFICE

CERTIFICATE OF CORRECTION

PATENT NO. : 5,553,399

DATED : September 10, 1996

INVENTOR(S) : M. Strong

It is certified that error appears in the above-indentified patent and that said Letters Patent is hereby corrected as shown below:

| COLUMN | LINE | |
|---|---|---|
| Item [56] Title Page, cols. 1 & 2 | Refs. Cited (U.S. Pat. Docs.) | Insert following references: --2,845,723 8/1958 Arnold . . . . . 36/9R<br>3,145,487 8/1964 Cronin . . . . . 36/9R<br>3,221,422 12/1965 Lemeshnik . . . 36/9R<br>3,308,562 3/1967 Zimmon . . . . . 36/7.1R<br>3,352,032 12/1964 Yamaguchi . . . 36/9R<br>4,255,874 3/1981 Sironi . . . . . 36/59CX<br>4,281,466 8/1981 Malone . . . . . 36/7.1R<br>4,317,292 3/1982 Melton . . . . . 36/9R<br>4,538,366 9/1985 Norton . . . . . 36/59CX<br>4,852,272 8/1989 Chilewich et al. . . 36/9RX<br>4,896,438 1/1990 DeBease . . . . . 36/7.1R-- |
| [56] | Refs. Cited (U.S. Pat. Docs., Item 8) | "1,018,415" should read --1,018,145-- |

UNITED STATES PATENT AND TRADEMARK OFFICE

CERTIFICATE OF CORRECTION

PATENT NO. : 5,553,399

DATED : September 10, 1996

INVENTOR(S) : M. Strong

It is certified that error appears in the above-indentified patent and that said Letters Patent is hereby corrected as shown below:

| COLUMN | LINE | |
|---|---|---|
| 18 (Claim 13, | 21 line 1) | "of claim 2," should read --of claim 12,-- |
| 19 (Claim 25, | 6 line 6) | "(b)a" should read --(b) a-- |

Signed and Sealed this

Fifth Day of August, 1997

Bruce Lehman

*Attest:*

BRUCE LEHMAN

*Attesting Officer*

*Commissioner of Patents and Trademarks*